US009413123B2

(12) United States Patent
Kao et al.

(10) Patent No.: US 9,413,123 B2
(45) Date of Patent: Aug. 9, 2016

(54) ELECTRICAL PLUG CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Wen-Yu Wang, New Taipei (TW); Wen-Hsien Tsai, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/667,087

(22) Filed: Mar. 24, 2015

(65) Prior Publication Data

US 2015/0270659 A1 Sep. 24, 2015

(30) Foreign Application Priority Data

Mar. 24, 2014 (TW) ..... 103110940 A
Mar. 18, 2015 (TW) ..... 104108695 A

(51) Int. Cl.

| | |
|---|---|
| ***H01R 13/26*** | (2006.01) |
| ***H01R 13/6593*** | (2011.01) |
| ***H01R 24/64*** | (2011.01) |
| ***H01R 13/24*** | (2006.01) |
| *H01R 107/00* | (2006.01) |
| *H01R 9/05* | (2006.01) |
| *H01R 13/6585* | (2011.01) |
| *H01R 13/66* | (2006.01) |

(52) U.S. Cl.

CPC ..... *H01R 24/64* (2013.01); *H01R 13/2442* (2013.01); *H01R 9/05* (2013.01); *H01R 13/6585* (2013.01); *H01R 13/6658* (2013.01); *H01R 2107/00* (2013.01)

(58) Field of Classification Search

CPC .... H01R 13/22; H01R 13/24; H01R 13/2457; H01R 13/2492; H01R 13/26; H01R 27/00; H01R 13/658; H01R 13/6592; H01R 13/6593

See application file for complete search history.

(56) References Cited

U.S. PATENT DOCUMENTS

| | | | | |
|---|---|---|---|---|
| 6,368,121 | B1 * | 4/2002 | Ueno | H01R 13/6585 439/108 |
| 7,144,262 | B2 * | 12/2006 | Cheng | H04M 1/0254 439/151 |
| 7,354,314 | B1 * | 4/2008 | Sprouse | H01R 13/642 439/660 |
| 7,611,362 | B2 * | 11/2009 | Lin | H01R 12/7029 439/79 |
| 7,611,386 | B1 * | 11/2009 | Zhang | H01R 12/725 439/660 |
| 7,909,647 | B2 * | 3/2011 | Kawaguchi | H01R 9/035 439/585 |
| 8,517,766 | B2 * | 8/2013 | Golko | H01R 13/516 439/607.41 |
| 8,628,347 | B2 * | 1/2014 | Davis | H01R 13/629 439/374 |

(Continued)

*Primary Examiner* — Gary Paumen
(74) *Attorney, Agent, or Firm* — Muncy, Geissler, Olds & Lowe, P.C.

(57) ABSTRACT

An electrical plug connector includes a metal shell, an insulation housing, upper-row elastic terminals, and lower-row elastic terminals. The metal shell defines a receiving cavity to receive the insulation housing. The insulation housing includes an upper member, a lower member, and a mating room between the upper member and the lower member. The upper-row elastic terminals are held on a lower surface of the upper member and include upper-row elastic contact segments extending toward the mating room for transmitting first signals. The lower-row elastic terminals are held on an upper surface of the lower member and include lower-row elastic contact segments extending toward the mating room for transmitting second signals.

35 Claims, 19 Drawing Sheets

(56) References Cited

U.S. PATENT DOCUMENTS 8,864,528 B2 * 10/2014 Chung ..... H01R 13/6582 439/108
2008/0188136 A1 * 8/2008 Su ..... H01R 27/02 439/660
2010/0297889 A1 * 11/2010 Teramoto ..... H01R 13/64 439/660
2011/0111618 A1 * 5/2011 Su ..... H01R 13/512 439/357
2011/0294357 A1 * 12/2011 Tanaka ..... H01R 13/6471 439/660
2012/0045935 A1 * 2/2012 Zhang ..... H01R 12/724 439/607.08
2013/0065448 A1 * 3/2013 Chiu ..... H01R 27/00 439/660
2013/0078866 A1 * 3/2013 Su ..... H01R 12/57 439/660
2013/0164990 A1 * 6/2013 Tsai ..... H01R 13/516 439/660
2013/0244491 A1 * 9/2013 Sarwar ..... H01R 24/60 439/655
2014/0024263 A1 * 1/2014 Dong ..... H01R 13/516 439/660
2014/0113487 A1 * 4/2014 Chen ..... H01R 24/62 439/607.01
2014/0235108 A1 * 8/2014 Shiratori ..... H01R 13/652 439/660
2014/0335738 A1 * 11/2014 Chen ..... H01R 24/60 439/660
2015/0024612 A1 * 1/2015 Little ..... H05K 1/117 439/55

* cited by examiner

| | | | | | | | | | | | | | | | |
|---|---|---|---|---|---|---|---|---|---|---|---|---|---|---|---|
| GND | RX2+ | RX2− | VBUS | RFU | D− | D+ | CC1 | VBUS | TX1− | TX1+ | GND | 31 |
| GND | TX2+ | TX2− | VBUS | CC2 | D+ | D− | RFU | VBUS | RX1− | RX1+ | GND | 41 |

ELECTRICAL PLUG CONNECTOR

CROSS-REFERENCES TO RELATED APPLICATIONS

This non-provisional application claims priority under 35 U.S.C. §119(a) on Patent Application No. 103110940 and 104108695, filed in Taiwan, R.O.C. on Mar. 24, 2014 and Mar. 18, 2015, the entire contents of which are hereby incorporated by reference.

FIELD OF THE INVENTION

The instant disclosure relates to an electrical connector, and more particularly to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use, from the end user's point of view. Now, as technology innovation marches forward, new kinds of devices, media formats and large inexpensive storage products are converging. They require significantly more bus bandwidth to maintain the interactive experience that users have come to expect. In addition, user applications demand a higher performance between the PC and sophisticated peripherals. The transmission rate of USB 2.0 is insufficient. Consequently, faster serial bus interfaces, such as USB 3.0, have been developed to address the need by adding a higher transmission rate to match usage patterns and devices.

A conventional USB electrical receptacle connector includes plate transmission terminals and a USB electrical plug connector includes elastic transmission terminals. When the conventional USB electrical receptacle connector with the conventional USB electrical plug connector in an improper orientation, the elastic transmission terminals or a tongue portion of the conventional USB electrical plug connector may be damaged or even broken, resulting in the disablement of the elastic transmission terminals or the tongue portion.

Furthermore, the surface of an iron shell of the conventional USB electrical receptacle connector or the surface of the conventional USB electrical plug connector is provided with a crack for firmly connection. However, these cracks would adversely influence the shielding effect of the iron shell to induce interferences (such as Electromagnetic Interference (EMI), Radio-Frequency Interference (RFI), and the like), with other signals during signal transmission. Therefore, a problem of serious crosstalk between the terminals of conventional connector is to be solved.

SUMMARY OF THE INVENTION

In view of the above-mentioned problems, the instant disclosure provides an electrical plug connector. The electrical plug connector comprises a metal shell, an insulation housing, a plurality of upper-row elastic terminals, and a plurality of lower-row elastic terminals. The metal shell defines a receiving cavity therein. The insulation housing is in the receiving cavity and comprises an upper member, a lower member, and a mating room. The mating room is located between the upper member and the lower member. The upper-row elastic terminals are held on a lower surface of the upper member and comprise a plurality of upper-row elastic signal terminals, at least one upper-row elastic power terminal, and at least one upper-row elastic ground terminal. The upper-row elastic terminals are at the insulation housing. The lower-row elastic terminals are held on an upper surface of the lower member and comprise a plurality of lower-row elastic signal terminals, at least one lower-row elastic power terminal, and at least one lower-row elastic ground terminal. The lower-row elastic terminals are at the insulation housing. Wherein the upper-row elastic signal terminals are at the lower surface of the upper member for transmitting first signals, the lower-row elastic signal terminals are at the upper surface of the lower member for transmitting second signals, the specification for transmitting the first signals is conformed to the specification for transmitting the second signals, and the upper-row elastic terminals and the lower-row elastic terminals are point-symmetrical with a central point of the receiving cavity as the symmetrical center.

In conclusion, since the upper-row elastic terminals and the lower-row elastic terminals are arranged upside down, and the pin configuration of the upper-row elastic signal terminals is left-right reversal with respect to that of the lower-row elastic signal terminals. When the electrical plug connector is inserted into an electrical receptacle connector by a first orientation where an upper plane of the electrical plug connector is facing up, the upper-row elastic terminals of the electrical plug connector are in contact with upper-row plate signal terminals of the electrical receptacle connector. Conversely, when the electrical plug connector is inserted into the electrical receptacle connector by a second orientation where the upper plane of the electrical plug connector is facing down, the upper-row elastic terminals of the electrical plug connector are in contact with lower-row plate signal terminals of the electrical receptacle connector. Consequently, the inserting orientation of the electrical plug connector is not limited when inserting into an electrical receptacle connector. Besides, a plurality of clamping structures are extending and inserted into two sides of the mating room to be in contact with hook structures located at two sides of an electrical receptacle connector. Therefore, the clamping structures are connected to the metal shell for conduction and grounding. Furthermore, a grounding sheet is located on the insulation housing and between the upper-row elastic terminals and the lower-row elastic terminals, thus the crosstalk interference can be improved by the grounding sheet during signal transmission.

Detailed description of the characteristics and the advantages of the instant disclosure is shown in the following embodiments, the technical content and the implementation of the instant disclosure should be readily apparent to any person skilled in the art from the detailed description, and the purposes and the advantages of the instant disclosure should be readily understood by any person skilled in the art with reference to content, claims and drawings in the disclosure.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

Figure 1:
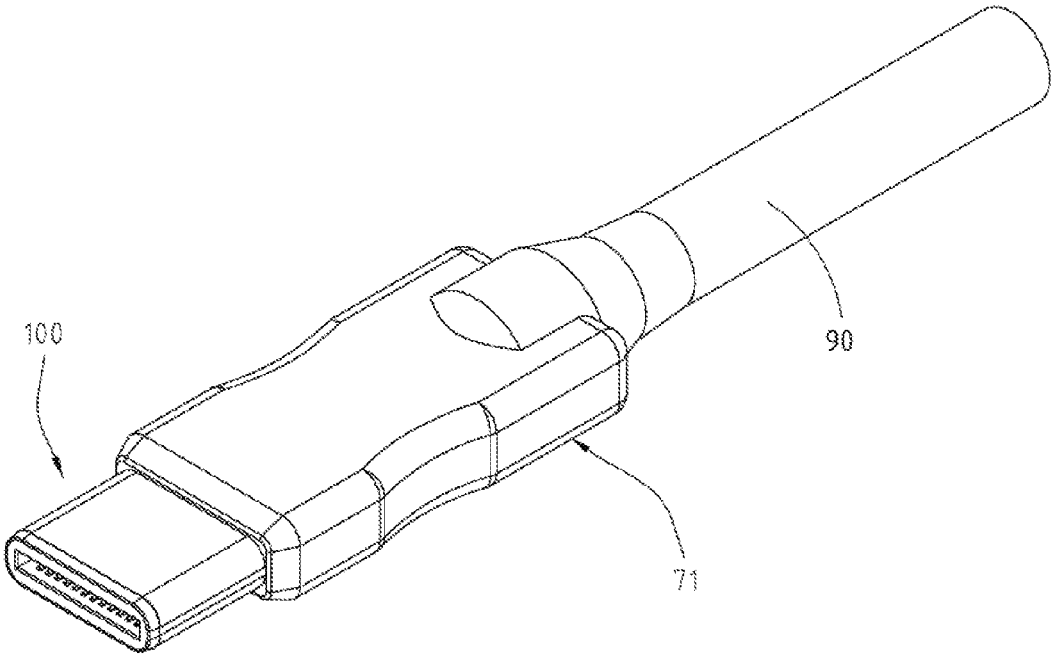
FIG. 1 illustrates a perspective view of an electrical plug connector according to the instant disclosure, where the electrical plug connector is combined with an insulation casing and a cable.
Figure 2:
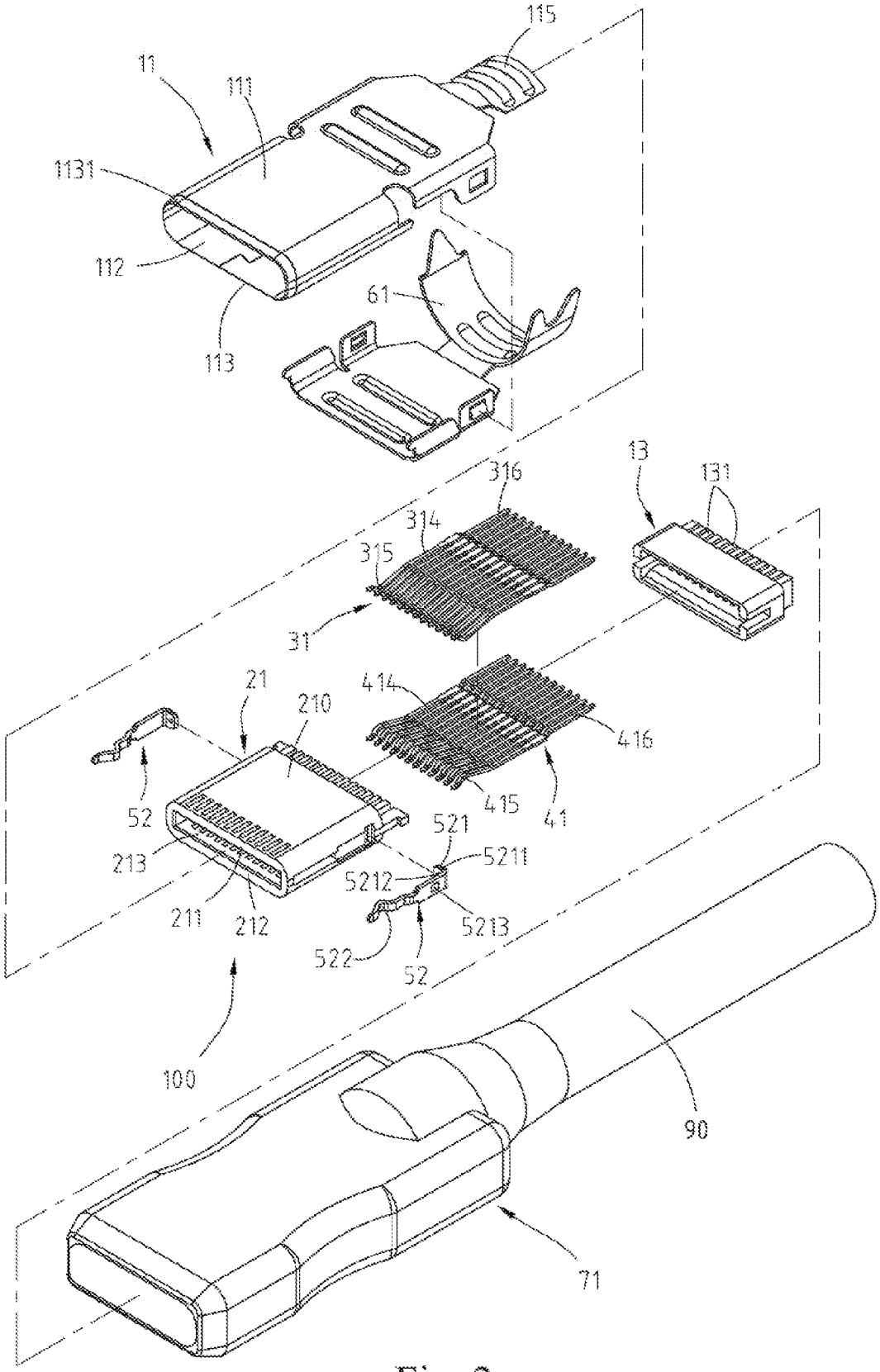
FIG. 2 illustrates an exploded view of the electrical plug connector according to the instant disclosure, where the electrical plug connector is to be assembled with the insulation casing and the adapting cable.
Figure 3:
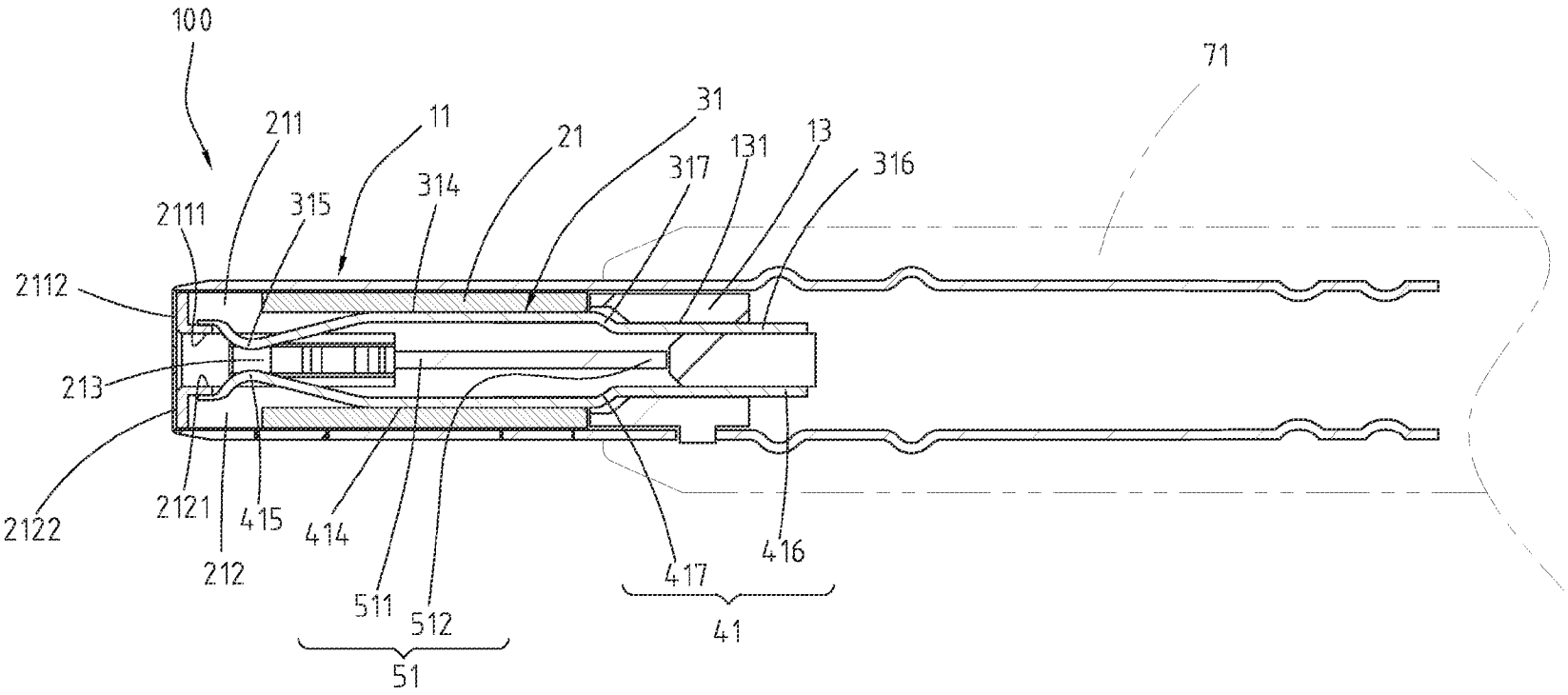
FIG. 3 illustrates a partial cross-sectional view of the electrical plug connector according to the instant disclosure combined with the insulation casing.

Please refer to FIGS. 1, 2 and 3, illustrating exemplary embodiments of an electrical plug connector 100 according to the instant disclosure is combined with an insulation casing 71 and a cable 90, but the embodiments are not thus limited thereto. In some embodiments, the electrical plug connector 100 may be combined with a circuit board 91 (shown as FIG. 6A) to form a flash drive or a vertical charging dock without the cable 90. FIG. 1 is a perspective view, FIG. 2 is an exploded view, and FIG. 3 is a partial cross-sectional view of the electrical plug connector. The electrical plug connector 100 according to the instant disclosure is in accordance with the specification of a USB type-C connection interface. In the embodiment, the electrical plug connector 100 mainly comprises a metal shell 11, an insulation housing 21, a plurality of upper-row elastic terminals 31, and a plurality of lower-row elastic terminals 41.

Figure 6A:
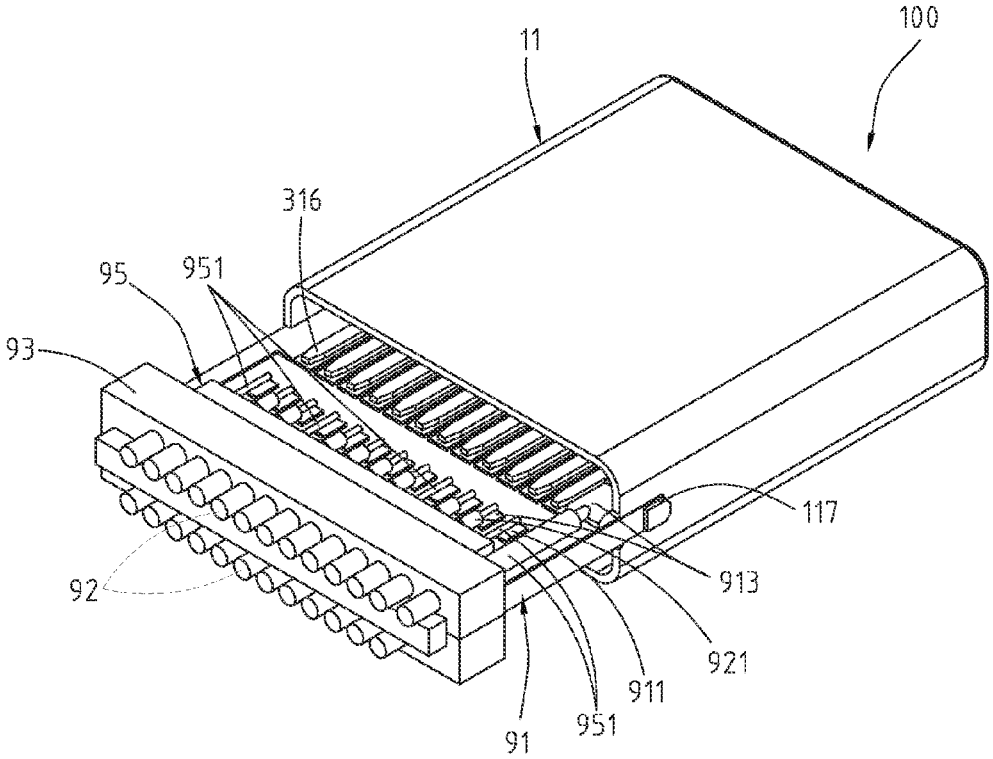
FIG. 6A illustrates a perspective view of the electrical plug connector according to the instant disclosure, where the electrical plug connector is connected to a ground plate.
Figure 6B:
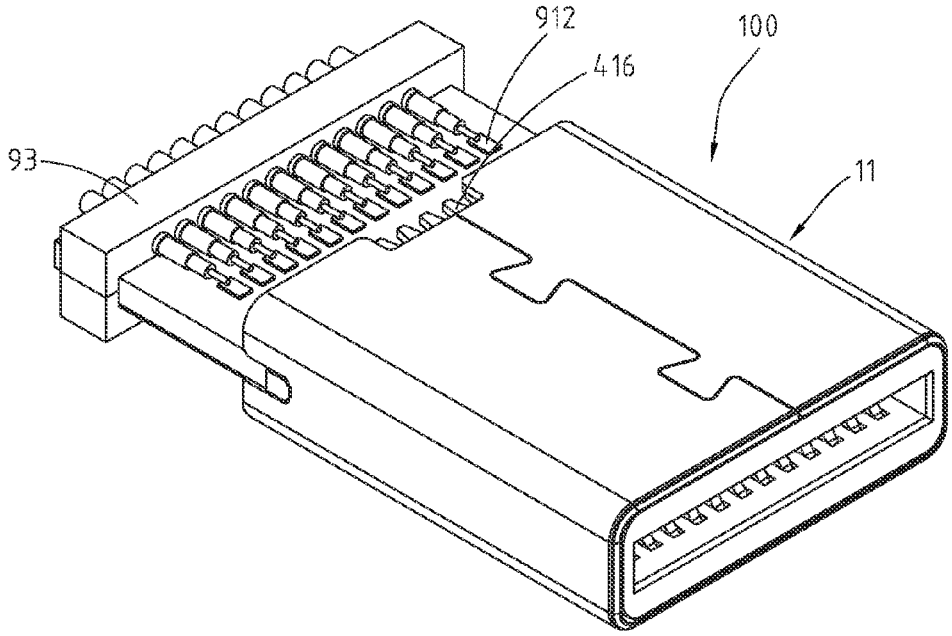
FIG. 6B illustrates a perspective view of the electrical plug connector according to the instant disclosure, where the electrical plug connector is connected to a plurality of wires, for one variation.
Figure 11:
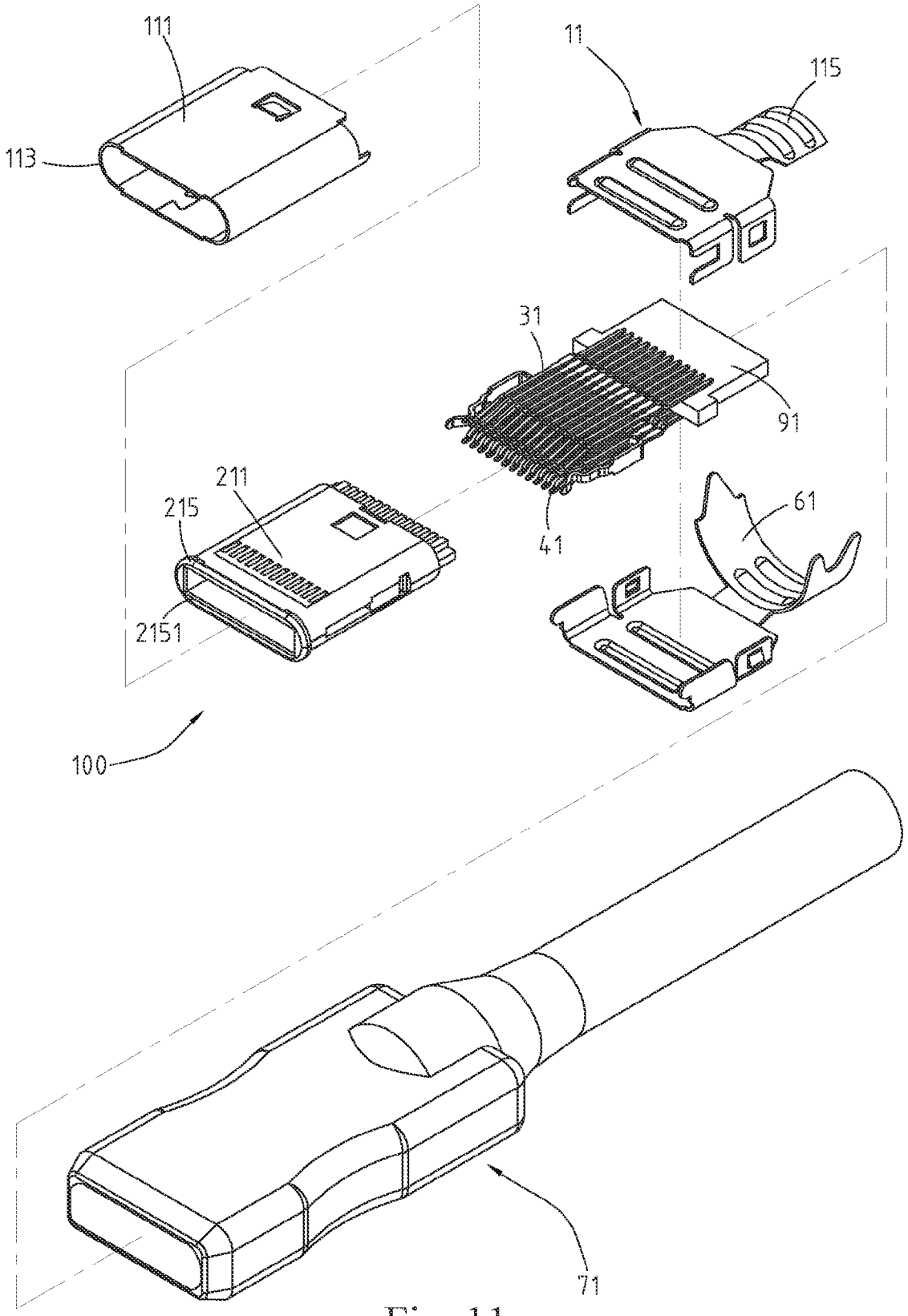
FIG. 11 illustrates an exploded view of the electrical plug connector provided with a frame portion.
Figure 14:
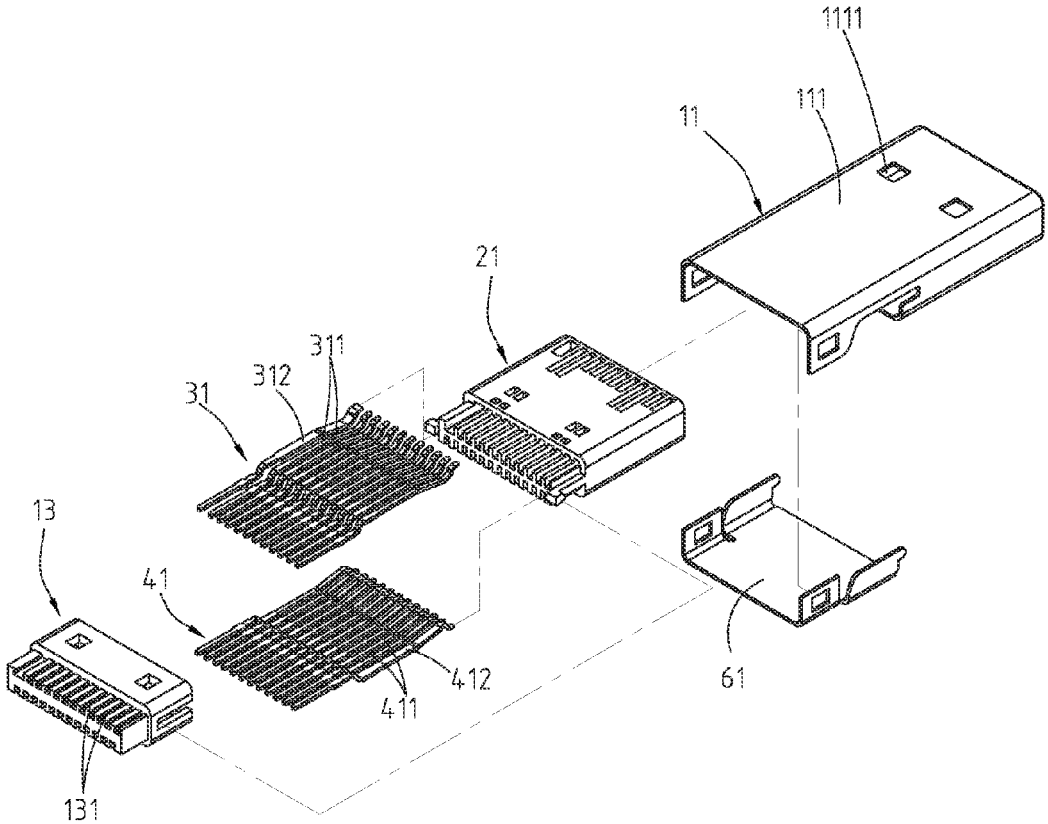
FIG. 14 illustrates an exploded view of the electrical plug connector provided with the buckle holes.

The metal shell 11 is a hollow shell and defines a receiving cavity 112 therein. In the embodiment, the metal shell 11 is formed by bending a unitary structured, main body 111. In some embodiments, the main body 111 may be formed as a two-piece structure (as shown in FIG. 11). The connection between the two pieces of the main body 111 can be formed by a dovetail manner (as shown in FIG. 6B), an overlapped manner, or an extruded manner. In addition after bending, the connection between the two pieces of the main body 111 can be lined up to each other or tilted toward the interior of the receiving cavity 112 (i.e., the connection between the two pieces of the main body 111 is formed as a V profile when viewing laterally). Besides, the metal shell 11 may be provided with a plurality of buckle holes 1111 formed on the surface of the main body 111 and defined through the surface of the metal shell 11 (as shown in FIG. 14). Alternatively, in some embodiments, the metal shell 11 is devoid of the buckle holes 1111 (as shown in FIG. 2). In addition, a plug opening 113, in oblong shaped, is formed on one side of the metal shell 11 (as shown in FIG. 2). Alternatively, a plug opening 113, in rectangular shaped, is formed on one side of the metal shell 11 (as shown in FIG. 6B). Additionally, the plug opening 113 communicates with the receiving cavity 112.

The insulation housing 21 is in the receiving cavity 112 and comprises a base portion 210, an upper member 211, a lower member 212, and a mating room 213. The base portion 210, the upper member 211, the lower member 212 described herein are formed by injection-molding, and defines the mating room 213 therebetween. Specifically, the upper member 211 and the lower member 212 are extending from one side of the base portion 210. In addition, the mating room 213 is located between the upper member 211 and the lower member 212. The upper member 211 is provided with a lower surface 2111 and an upper front lateral surface 2112, the lower member 212 is provided with an upper surface 2121 and a lower front lateral surface 2122. The lower surface 2111 of the upper member 211 is opposite to the upper surface 2121 of the lower member 212.

Figures 4A, 4B:
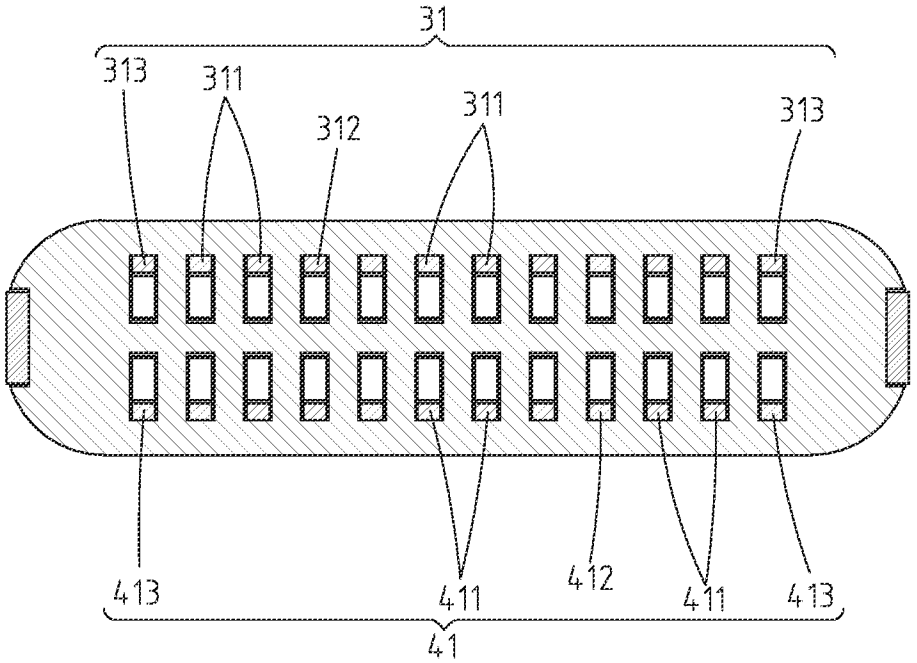
FIG. 4A illustrates a front sectional view of the electrical plug connector according to the instant disclosure.
FIG. 4B is a schematic configuration diagram of the elastic terminals of the electrical plug connector shown in FIG. 4A.
Figure 15:
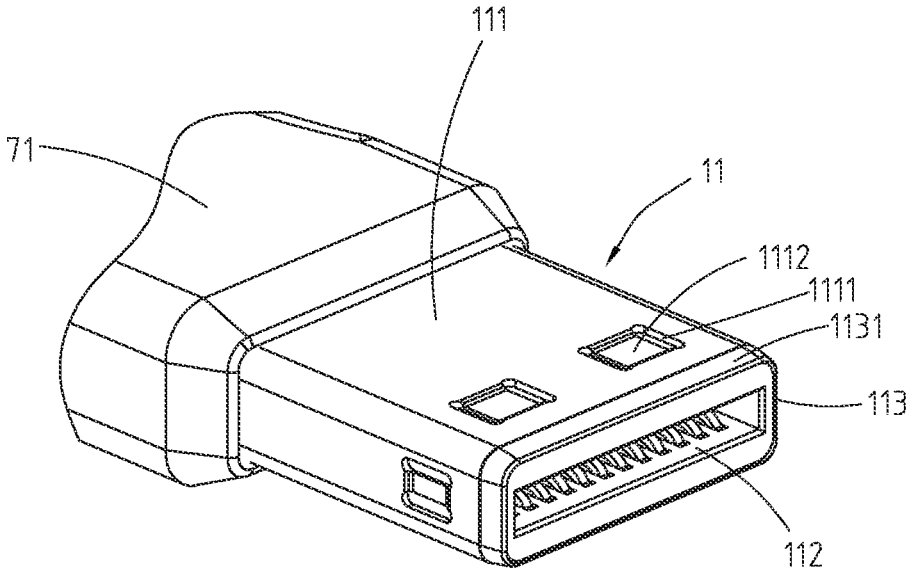
FIG. 15 illustrates a perspective view of the electrical plug connector provided with extension sheets.

Please refer to FIG. 4A and FIG. 4B, in which the upper-row elastic terminals 31 comprises a plurality of upper-row elastic signal terminals 311, at least one upper-row elastic power terminal 312 and at least one upper-row elastic ground terminal 313. As shown in FIG. 4B, the upper-row elastic terminals 31 comprise, from right to left, an upper-row elastic ground terminal 313 (Gnd), a first pair of differential signal terminals (TX1+−), a second pair of differential signal terminals (D+−), and a third pair of differential signal terminals (RX2+−), of the upper-row elastic signal terminals 311, upper-row elastic power terminals 312 (Power/VBUS), between the three pairs of differential signal terminals, a retain terminal (RFU), (the retain terminal and a configuration channel 1 (CC1) are respectively arranged between the upper-row elastic power terminals 312 (Power/VBUS) and the second pair of differential signal terminals of the upper-row elastic signal terminals 311), and an upper-row elastic ground terminal 313 at the leftmost side. However, the pin configuration described herein is an example for illustrative purpose, but not a limitation. The electrical plug connector 100 described herein may comprise, but not limited to, twelve upper-row elastic terminals 31 for transmitting USB 3.0 signals. In some embodiments, the rightmost (or leftmost) upper-row elastic ground terminal 313 (Gnd) and the retain terminal (RFU) can be omitted. Besides, the rightmost upper-row elastic ground terminal 313 (Gnd) may be replaced by an upper-row elastic power terminal 312 (Power/VBUS) and provided for power transmission. Here, the width of the upper-row elastic power terminal 312 (Power/VBUS) may be, but not limited to, equal to the width of each of the upper-row elastic signal terminals 311. In some embodiments, the width of the upper-row elastic power terminal 312 may be greater than the width of each of the upper-row elastic signal terminals 311 (as shown in FIG. 15). Accordingly, the electrical plug connector 100 is applicable for an electronic product required for high current transmission.

Please refer to FIG. 2 and FIG. 3, in which each of the upper-row elastic terminals 31 comprises an upper-row contact segment 315, an upper-row connecting segment 314, and an upper-row soldering segment 316. For each upper-row elastic terminal 31, the upper-row connecting segment 314 is at the upper member 211, the upper-row contact segment 315 is extending from one of two ends of the upper-row connecting segment 314 and at the lower surface 2111 of the upper member 211, and the upper-row soldering segment 316 is extending from the other end of the upper-row connecting segment 314 and protruded out of the insulation housing 21. The upper-row elastic signal terminals 311 are extending toward the mating room 213 for transmitting first signals (i.e., USB 3.0 signals). The upper-row soldering segments 316 are protruded out of the rear part of the insulation housing 21. Moreover, the upper-row soldering segments 316 are horizontally aligned and separated from the lower-row soldering segments 416, so that the upper-row soldering segments 316 and the lower-row soldering segments 416 are formed as two lines. Alternatively, by bending the upper-row soldering segments 316, the upper-row soldering segments 316 and the lower-row soldering segments 416 may be formed as one line.

Please refer to FIG. 3, in which embodiment the distance between the upper-row elastic power terminal 312 and the upper front lateral surface 2112 of the upper member 211 is equal to the distance between each of the upper-row elastic signal terminals 311 and the upper front lateral surface 2112 of the upper member 211. In addition, the distance between the upper-row elastic ground terminal 313 and the upper front lateral surface 2112 of the upper member 211 is equal to the distance between each of the upper-row elastic signal terminals 311 and the upper front lateral surface 2112 of the upper member 211. That is, each of the upper-row elastic terminals 31 described herein has an identical length, but embodiments are not thus limited thereto.

In some embodiments, the upper-row elastic terminals 31 are provided with different lengths (not shown). In other words, the distance between the upper-row elastic power terminal 312 and the upper front lateral surface 2112 of the upper member 211 is less than the distance between each of the upper-row elastic signal terminals 311 and the upper front lateral surface 2112 of the upper member 211. Moreover, the distance between the upper-row elastic ground terminal 313 and the upper front lateral surface 2112 of the upper member 211 is less than the distance between each of the upper-row elastic signal terminals 311 and the upper front lateral surface 2112 of the upper member 211. When the electrical plug connector 100 is plugged into an electrical receptacle connector, the upper-row elastic power terminal 312 or the upper-row elastic ground terminal 313 is preferentially in contact with the terminals of the electrical receptacle connector, and the upper-row elastic signal terminals 311 are then in contact with the terminals of the electrical receptacle connector. Accordingly, the electrical plug connector 100 is ensured to be completely plugged into the electrical receptacle connector (i.e., to be plugged into the electrical receptacle connector properly), before power or signal transmission. It should be understood that if the electrical plug connector 100 is not completely plugged into the electrical receptacle connector, arc burn may occur due to poor contact between the upper-row elastic signal terminal 311 and the terminals of the electrical receptacle connector. Therefore, based on the upper-row elastic terminals 31 with different lengths, the arc burn problem can be prevented.

Please refer to FIG. 4A and FIG. 4B, in which the lower-row elastic terminals 41 comprises a plurality of lower-row elastic signal terminals 411, at least one lower-row elastic power terminal 412, and at least one lower-row elastic ground terminal 413. As shown in FIG. 4B, the lower-row elastic terminals 41 comprise, from left to right, a lower-row elastic ground terminal 413 (Gnd), a first pair of differential signal terminals (TX2+−), a second pair of differential signal terminals (D+−), and a third pair of differential signal terminals (RX1+−), of the lower-row elastic signal terminals 411, lower-row elastic power terminals 412 (Power/VBUS), between the three pairs of differential signal terminals, a retain terminal (RFU), (the retain terminal and a configuration channel 2 (CC2) are respectively arranged between the lower-row elastic power terminals 412 (Power/VBUS) and the second pair of differential signal terminals of the lower-row elastic signal terminals 411), and a lower-row elastic ground terminal 413 (Gnd) at the rightmost side. However, the pin configuration described herein is an example for illustrative purpose, but not a limitation. The electrical plug connector 100 described herein may include, but not limited to, twelve lower-row elastic terminals 41 for transmitting USB 3.0 signals. In some embodiments, the rightmost (or leftmost) lower-row elastic ground terminal 413 (Gnd) and the retain terminal (RFU) can be omitted. Besides, the leftmost lower-row elastic ground terminal 413 (Gnd) can be replaced by a lower-row elastic power terminal 412 (Power/VBUS) and provided for power transmission. Here, the width of the lower-row power terminal 412 (Power/VBUS) may be, but not limited to, equal to that of each of the lower-row elastic signal terminals 411. In some embodiments, the width of the lower-row elastic power terminal 412 can also be greater than that of each of the lower-row elastic signal terminals 411 (as shown in FIG. 15). Accordingly, the electrical plug connector is applicable for the electronic product required for high current transmission.

Please refer to FIG. 2 and FIG. 3, in which each of the lower-row elastic terminals 41 comprises a lower-row contact segment 415, a lower-row connecting segment 414, and a lower-row soldering segment 416. For each lower-row elastic terminal 41, the lower-row connecting segment 414 is at the lower member 212, the lower-row contact segment 415 is extending from one of two ends of the lower-row connecting segment 414 and at the upper surface 2121 of the lower member 212, and the lower-row soldering segment 416 is extending from the other end of the lower-row connecting segment 414 and protruded out of the insulation housing 21. The lower-row elastic signal terminals 41 are extending toward the mating room 213 for transmitting second signals (i.e., USB 3.0 signals). The lower-row soldering segments 416 are protruded out of the rear part of the insulation housing 21. Moreover, the lower-row soldering segments 316 are horizontally aligned.

Please refer to FIG. 3, in which embodiment, the distance between the lower-row elastic power terminal 412 and the lower front lateral surface 2122 of the lower member 212 is equal to the distance between each of the lower-row elastic signal terminals 411 and the lower front lateral surface 2122 of the lower member 212. Moreover, the distance between the lower-row elastic ground terminal 413 and the lower front lateral surface 2122 of the lower member 212 is equal to the distance between each of the lower-row elastic signal terminals 411 and the lower front lateral surface 2122 of the lower member 212. That is, each of the lower-row elastic terminals 41 described herein has an identical length, but embodiments are not thus limited thereto.

In some embodiments, the lower-row elastic terminals 41 are provided with different lengths (not shown). In other words, the distance between the lower-row elastic power terminal 412 and the lower front lateral surface 2122 of the lower member 212 is less than the distance between each of the lower-row elastic signal terminals 411 and the lower front lateral surface 2122 of the lower member 212, and, the distance between the lower-row elastic ground terminal 413 and the lower front lateral surface 2122 of the lower member 212 is less than the distance between each of the lower-row elastic signal terminals 411 and the lower front lateral surface 2122 of the lower member 212. When the electrical plug connector 100 is plugged into the electrical receptacle connector, the lower-row elastic power terminal 412 or the lower-row elastic ground terminal 413 is preferentially in contact with the terminals of the electrical receptacle connector, and the lower-row elastic signal terminal 411 are then in contact with the terminals of the electrical receptacle connector. Accordingly, the electrical plug connector 100 is ensured to be completely plugged into the electrical receptacle connector (i.e., to be plugged into the electrical receptacle connector properly), before power or signal transmission. It should be understood that if the electrical plug connector 100 is not completely plugged into the electrical receptacle connector, arc burn may occur due to poor contact between the lower-row elastic signal terminal 413 and the terminals of the electrical receptacle connector. Therefore, based on the lower-row elastic terminals 41 with different lengths, the arc burn problem can be prevented.

Please refer back to FIG. 2, FIG. 3, FIG. 4A and FIG. 4B, in which embodiment the upper-row elastic terminals 31 and the lower-row elastic terminals 41 are respectively at the lower surface 2111 of the upper member 211 and the upper surface 2121 of the lower member 212. Additionally, pin configuration of the upper-row elastic terminals 31 and the lower-row elastic terminals 41 are point-symmetrical with a central point of the receiving cavity 112 as the symmetrical center. Here, point-symmetry means that after the upper-row elastic terminals 31 (or the lower-row elastic terminals 41), are rotated by 180 degrees with the symmetrical center as the rotating center, the upper-row elastic terminals 31 and the lower-row elastic terminals 41 are overlapped. That is, the rotated upper-row elastic terminals 31 are arranged at the position of the original lower-row elastic terminals 41, and the rotated lower-row elastic terminals 41 are arranged at the position of the original upper-row elastic terminals 31. In other words, the upper-row elastic terminals 31 and the lower-row elastic terminals 41 are arranged upside down, and the pin configuration of the upper-row elastic terminals 31 are left-right reversal with respect to that of the lower-row elastic terminals 41. The electrical plug connector 100 is inserted into an electrical receptacle connector with a first orientation where the upper plane of the electrical plug connector 100 is facing up (i.e., the lower surface 2111 of the upper member 211 is facing down), for transmitting first signals. Conversely, the electrical plug connector 100 is inserted into the electrical receptacle connector with a second orientation where the upper plane of the electrical plug connector 100 is facing down (i.e., the upper surface 2121 of the lower member 212 is facing up), for transmitting second signals. Besides, the specification for transmitting the first signals is conformed to the specification for transmitting the second signals. Note that, the inserting orientation of the electrical plug connector 100 is not limited by the electrical receptacle connector.

Figure 17:
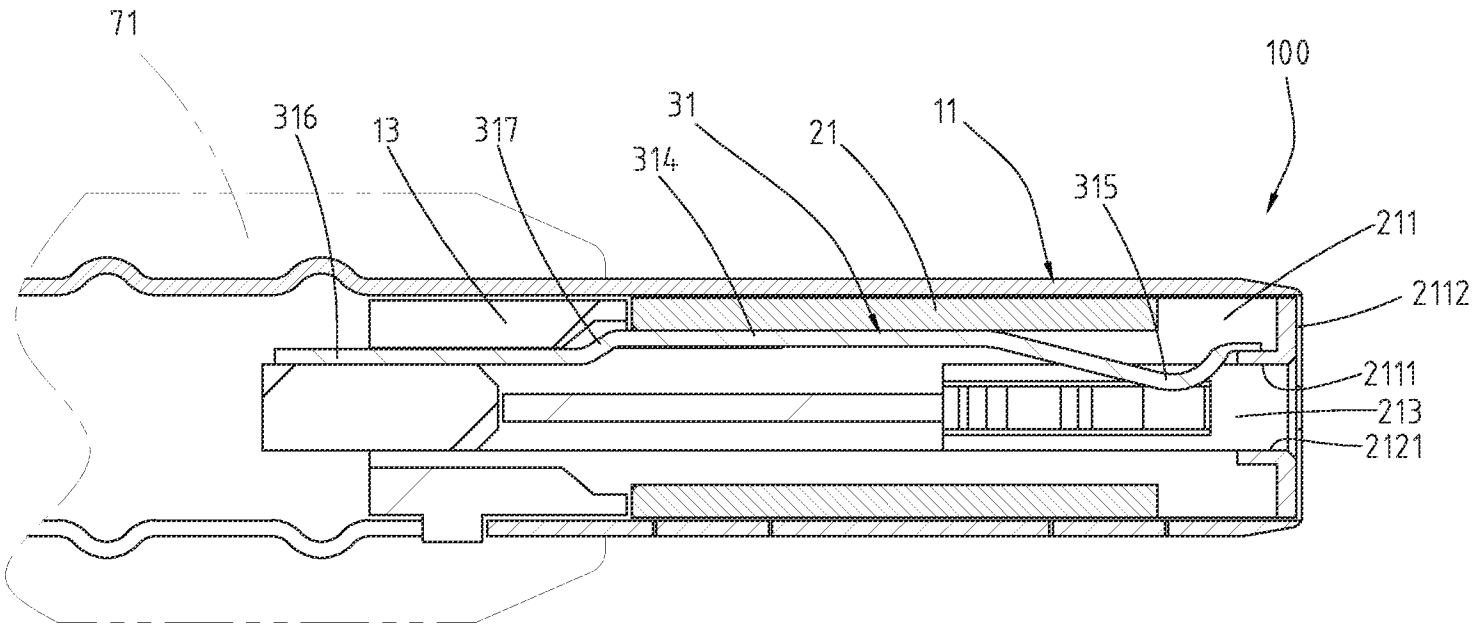
FIG. 17 illustrates a cross-sectional view of the electrical plug connector only provided with a plurality of upper-row elastic terminals.
Figure 18:
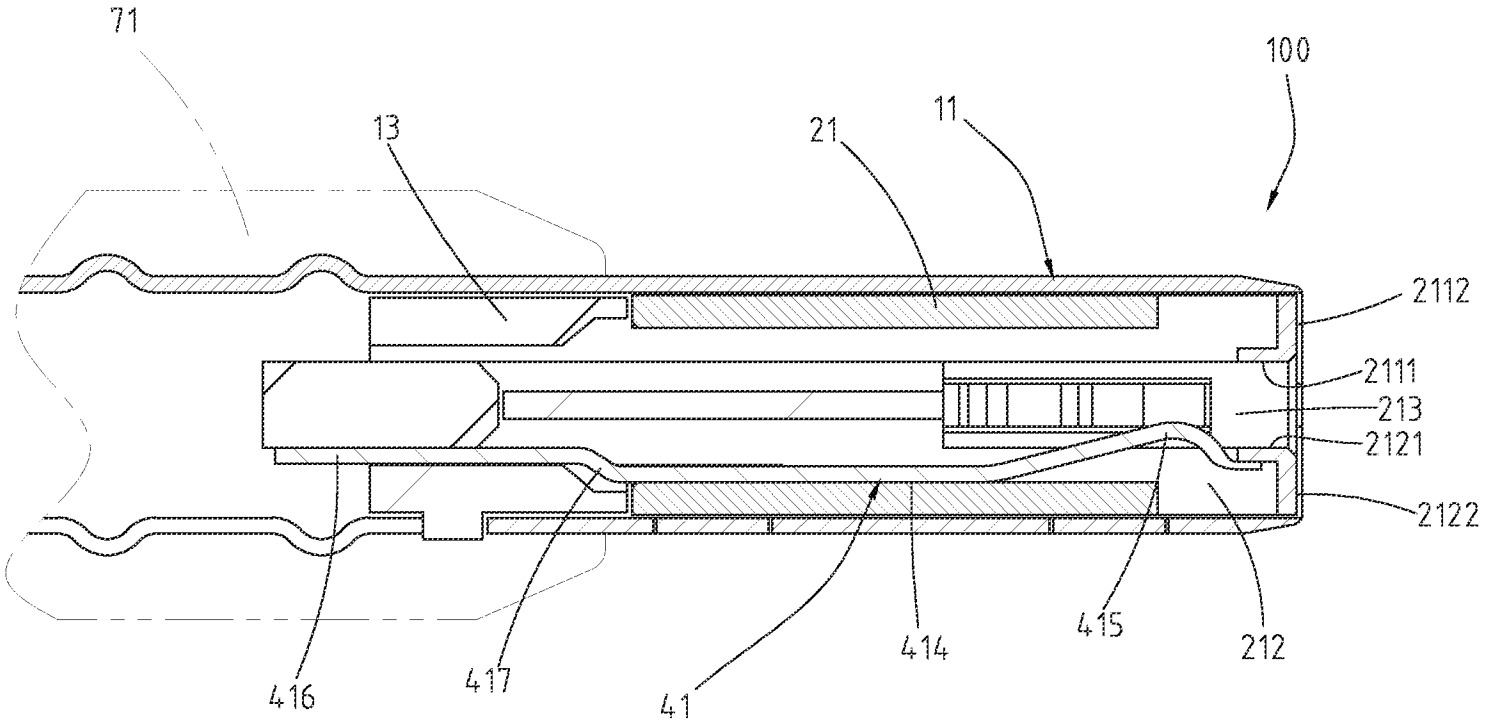
FIG. 18 illustrates a cross-sectional view of the electrical plug connector only provided with a plurality of lower-row elastic terminals.

Furthermore, in some embodiments, when an electrical receptacle connector to be mated with the electrical plug connector is provided with plural upper-row terminals and lower-row terminals, the electrical plug connector 100 may be devoid of the upper-row elastic terminals 31 or the lower-row elastic terminals 41 (as shown in FIG. 17 and FIG. 18). Regarding the upper-row elastic terminals 31 are omitted, when the electrical plug connector 100 is inserted into the electrical receptacle connector with the first orientation or the second orientation, the lower-row elastic terminals 41 of the electrical plug connector 100 are in contact with the upper-row terminals or the lower-row terminals of the electrical receptacle connector. Conversely, regarding the lower-row elastic terminals 41 are omitted, when the electrical plug connector 100 is inserted into the electrical receptacle connector with the first orientation or the second orientation, the upper-row elastic terminals 31 of the electrical plug connector 100 are in contact with the upper-row terminals or the lower-row terminals of the electrical receptacle connector. Accordingly, the inserting orientation of the electrical plug connector 100 is not limited by the orientation of the electrical receptacle connector.

Figure 5:
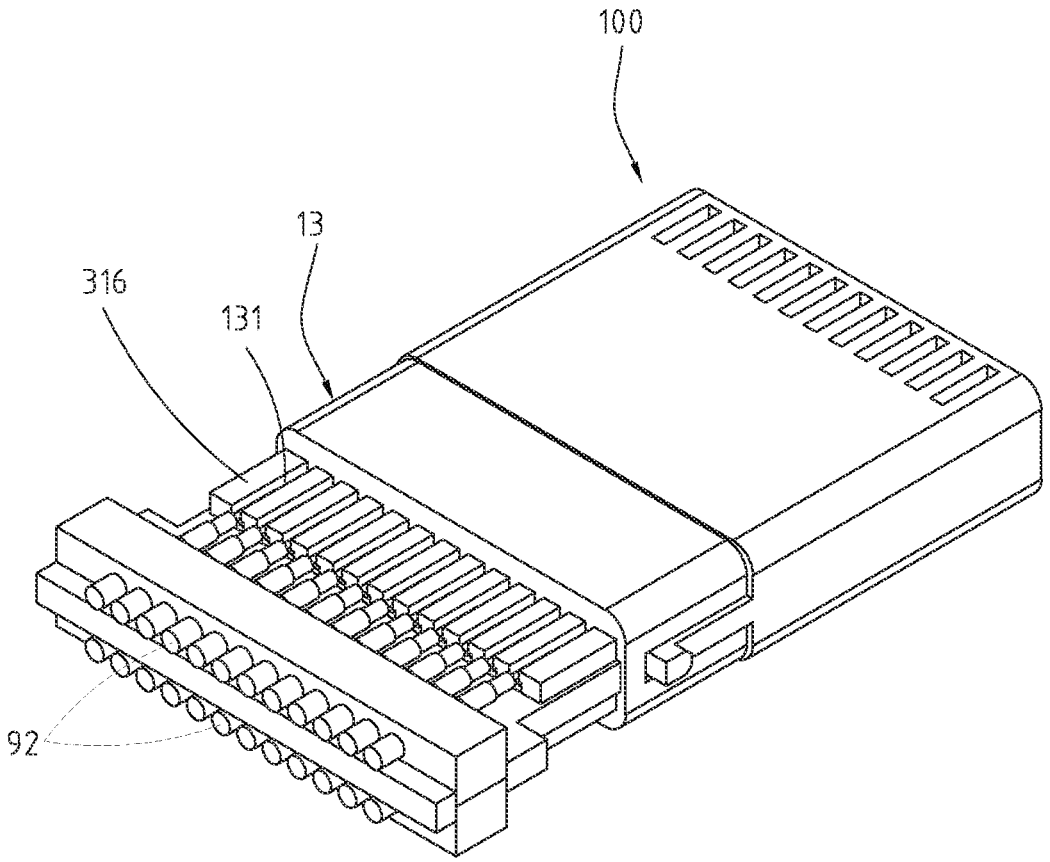
FIG. 5 illustrates a perspective view of the electrical plug connector according to the instant disclosure, where the electrical plug connector is connected to a plurality of wires.

Please refer to FIG. 3, in which embodiment, the upper-row soldering segments 316 and the lower-row soldering segments 416 are protruded out of the rear part of the insulation housing 21 to be separately arranged. The upper-row soldering segments 316 and the lower-row soldering segments 416 may be, but not limited to, arranged into two parallel lines, one by one. Here, each of the upper-row elastic terminals 31 is provided with an upper-row bending segment 317 extending between the upper-row connecting segment 314 and the upper-row soldering segment 316, and the upper-row bending segments 317 are provided for adjusting the distance between the upper-row soldering segments 316 and the lower-row soldering segments 416. Alternatively, each of the lower-row elastic terminals 41 may be provided with a lower-row bending segment 417 extending between the lower-row connecting segment 414 and the lower-row soldering segment 416, and the lower-row bending segments 417 are provided for adjusting the distance between the lower-row soldering segments 416 and the upper-row soldering segments 316. Accordingly, The upper-row soldering segments 316 and the lower-row soldering segments 416 can be directly connected to a plurality of wires 92 by soldering means (as shown in FIG. 5), or can be soldered on the circuit board 91 (as shown in FIG. 6A and FIG. 6B). Moreover, the upper-row bending segments 317 and the lower-row bending segments 417 enable the distance between the upper-row soldering segments 316 and the lower-row soldering segments 416 being adjustable. Additionally, the bending segments 317, 417 also allow proper spatial arrangement of the terminals and high-frequency characteristic. Here, the distance between the upper-row soldering segments 316 and the lower-row soldering segments 416 is greater than, or equal to over three times of the width of each of the upper-row elastic terminals 31 (or each of the lower-row elastic terminals 41). In addition, the distance between the upper-row elastic terminals 31 and the lower-row elastic terminals 41 can be 0.6 mm, 0.8 mm, or 1.0 mm.

Figure 9:
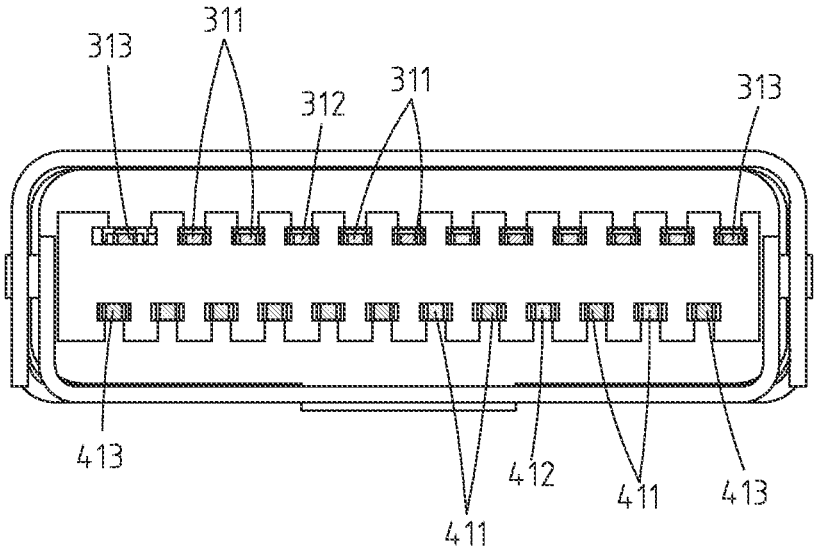
FIG. 9 is a front sectional view illustrating that the upper-row elastic terminals are offset with respect to the lower-row elastic terminals of the electrical plug connector according to the instant disclosure.

Please refer to FIG. 2, FIG. 3, and FIG. 4A, in which embodiment, the position of the upper-row elastic terminals 31 corresponds to the position of the lower-row elastic terminals 41, as shown in FIG. 4A. In other words, in the embodiment, the upper-row contact segments 315 are aligned to the lower-row contact segments 415, one by one, but embodiments are not thus limited. In some embodiments, the upper-row contact segments 315 are aligned parallel to the lower-row contact segments 415, and the upper-row contact segments 315 are offset with respect to the lower-row contact segments 415 (as shown in FIG. 9). Similarly, the upper-row soldering segments 316 may be offset with respect to the lower-row soldering segments 416. Therefore, crosstalk interference can be effectively improved with the offset configuration between the contact segments 315, 415 during signal transmission. Particularly, regarding the upper-row elastic terminals 31 and the lower-row elastic terminals 41 are configured with an offset, the terminals of the electrical receptacle connector would have to be configured correspondingly (i.e., the upper-row terminals and the lower-row terminals of the electrical receptacle connector are configured with an offset). Thus, the upper-row terminals and the lower-row terminals of the electrical receptacle connector can be correspondingly in contact with the upper-row elastic terminals 31 and the lower-row elastic terminals 41 for power or signal transmission.

In the above embodiments, the upper-row elastic terminals 31 or the lower-row elastic terminals 41 may be, but not limited to, provided for transmitting the USB 3.0 signals, individually. In some embodiments, for the upper-row elastic terminals 31, the first pair of differential signal terminals (TX1+−) and the third pair of differential signal terminals (RX2+−) of the upper-row elastic signal terminals 311 can be omitted, and the second pair of differential signal terminals (D+−) and the upper-row elastic power terminal 312 (Power/VBUS) are retained, when transmitting USB 2.0 signals. For the lower-row elastic terminals 41, the first pair of differential signal terminals (TX2+−) and the third pair of differential signal terminals (RX1+−) of the lower-row elastic signal terminals 411 can also be omitted, and the second pair of differential signal terminals (D+−) and the lower-row power terminal 412 (Power/VBUS) are retained, when transmitting USB 2.0 signals.

Please refer to FIG. 2 and FIG. 3. In some embodiments, the electrical plug connector 100 is combined with a rear plugging member 13. The rear plugging member is fixed at the rear part of the insulation housing 21. From a side view of the rear plugging member 13, the rear plugging member 13 is formed as a U-profile structure. The rear plugging member 13 defines a plurality of through grooves 131 therethrough, and the upper-row soldering segments 316 and the lower-row soldering segments 416 are held in the through grooves 131. That is, the rear plugging member 13 is fitted over the upper-row soldering segments 316 and the lower-row soldering segments 416 to enclose the periphery of the soldering segments 316, 416. Accordingly, when the electrical plug connector 100 is wrapped with an outer mould (e.g., a cover piece 94 in FIG. 7A), the rear plugging member 13 prevents glues of the outer mould from flowing out of the space between the upper-row soldering segments 316 and the lower-row soldering segments 416.

Please refer to FIG. 3, FIG. 5, and FIG. 4B. In some embodiments, the electrical plug connector 100 is further connected to the wires 92. When the upper-row soldering segments 316 and the lower-row soldering segments 416 are exposed out of the through grooves 131 of the rear plugging member 13, the wires 92 can be correspondingly soldered with the upper-row soldering segments 316 and the lower-row soldering segments 416 on the rear plugging member 13. In addition, the wires 92 connected to the electrical plug connector 100 can be of a coaxial structure, and the wires 92 can be soldered to the soldering segments 316, 416 via means of hot bar soldering, hot air fixing, or automatic ultrahigh-frequency soldering.

The electrical plug connector 100 combined with the rear plugging member 13 and soldered with the wires 92 described above is for illustrative purpose, embodiments are not limited thereto. In some embodiments, the electrical plug connector 100 may be combined with the circuit board 91 and devoid of the rear plugging member 13 (as shown in FIG. 6A). Here, the circuit board 91 is fixed at the rear part of the insulation housing 21. In other words, one of two sides of the circuit board 91 is soldered with the upper-row soldering segments 316 and the lower-row soldering segments 416 (as shown in FIG. 6A and FIG. 6B), and the other side of the circuit board 91 is connected to the wires 92. Here, a plurality of upper-surface contacts 911 is located on one of two surfaces of the circuit board 91 and connected to the upper-low soldering segments 316. Likewise, a plurality of lower-surface contacts 912 is located on the other surface of the circuit board 91 and connected to the lower-row soldering segments 416. The wires 92 may be soldered on at least one of the two surfaces of the circuit board 91. Particularly, the circuit board 91 is further provided with a plurality of ground contacts 913 used for grounding, the metal shell 11 is soldered with the ground contacts 913, and a ground wire 921 of the wires 92 is soldered with the ground contacts 913.

Please refer to FIG. 6A and FIG. 6B. In some embodiments, a plurality of fixing grooves 117 is defined at the rear part of the metal shell 11. The fixing grooves 117 are cut elongate grooves formed on the two sides of the metal shell 11. The width of each of the fixing grooves 117 is greater than the thickness of the circuit board 91, so that two sides of the circuit board 91 are held in the fixing grooves 117.

Please refer to FIG. 6A and FIG. 6B. In some embodiments, the electrical plug connector 100 is further provided with a ground plate 95. The ground plate 95 is a strip-shaped plate and integrated with the wires 92. The ground plate 95 is provided with a plurality of rods 951 protruded therefrom, at least one of the rods 951 is extending toward and in contact with at least one of ground contacts 913, and the rods 951 are further extending toward and in contact with the upper-surface contacts 911 of the circuit board 91. Accordingly, regarding the number of the wires 92 is reduced, the rods 951 are in contact with the upper-surface contacts 911 when the wires 92 are soldered with the upper-surface contacts 911.

Please refer to FIG. 6A and FIG. 6B. In some embodiments, the electrical plug connector 100 may be further combined with a fixing plate 93 when connecting to the wires 92. The fixing plate 93 is an elongate case. Here, plural fixing plates 93 are combined to the top and the bottom of the rear part of the circuit board 91, and the wires 92 may be then fixed with the fixing plates 93. The fixing between the wires 92 and the fixing plates 93 may be carried out with following means. In one embodiment, the fixing plates 93 are combined with the wires 92 during insert-molding. In one variation, the fixing plates 93 are buckled with the wires 92. Or, the fixing plates 93 are fixed with the wires 92 via an auxiliary tool.

Figure 7A:
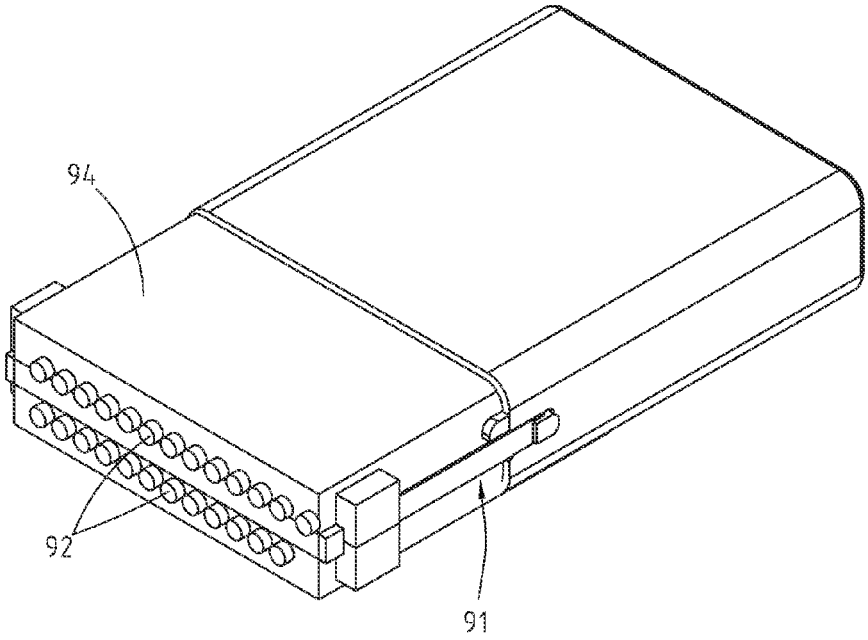
FIG. 7A illustrates a perspective view of the electrical plug connector according to the instant disclosure, where the electrical plug connector is combined with a cover piece.
Figure 7B:
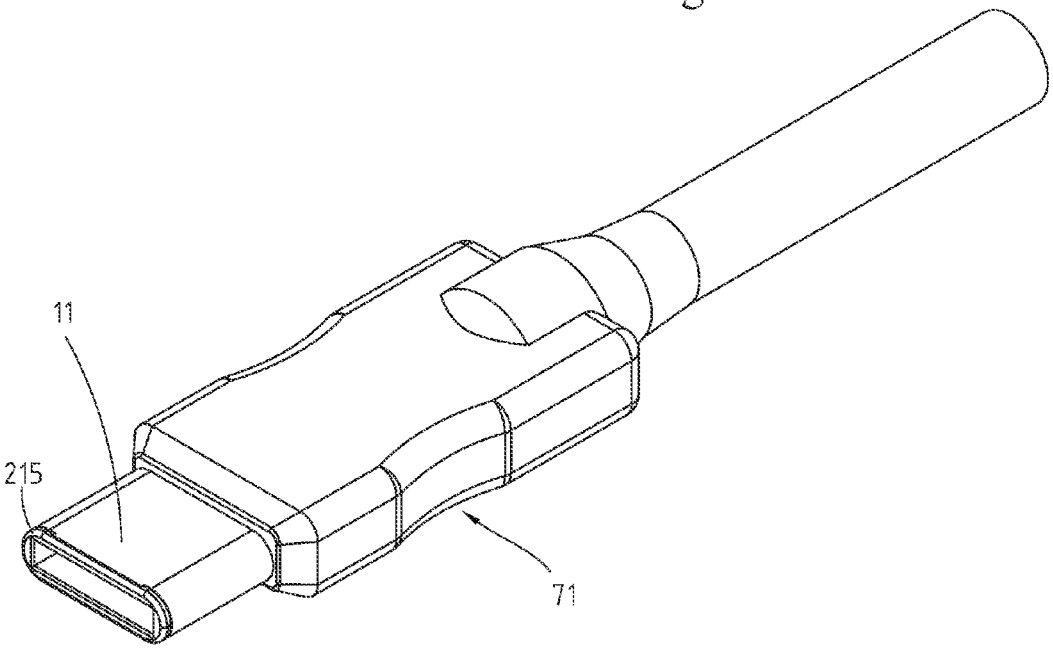
FIG. 7B illustrates a perspective view of the electrical plug connector according to the instant disclosure, where the electrical plug connector is combined with an insulation casing.

Please refer to FIG. 7A and FIG. 7B. In some embodiments, the electrical plug connector 100 may be further combined with the cover piece 94 (an inner mould) and the insulation casing 71 (the outer mould). The cover piece 94 covers the wires 92, the upper-row soldering segments 316, and the lower-row soldering segments 416. When the wires 92 are soldered on the circuit board 91, the cover piece 94 may be combined with the electrical plug connector 100 by means of gluing or over-molding. Therefore, the wires 92, the upper-row soldering segments 316, and the lower-row soldering segments 416 are securely fixed to the circuit board 91. Besides, the insulation casing 71 is further combined with the electrical plug connector 100 by means of over-molding, so that the wires 92 and the rear part of the metal shell 11 are enclosed properly. Accordingly, an electrical plug connector 100 provided with the wire 92 is carried out.

Figure 8A:
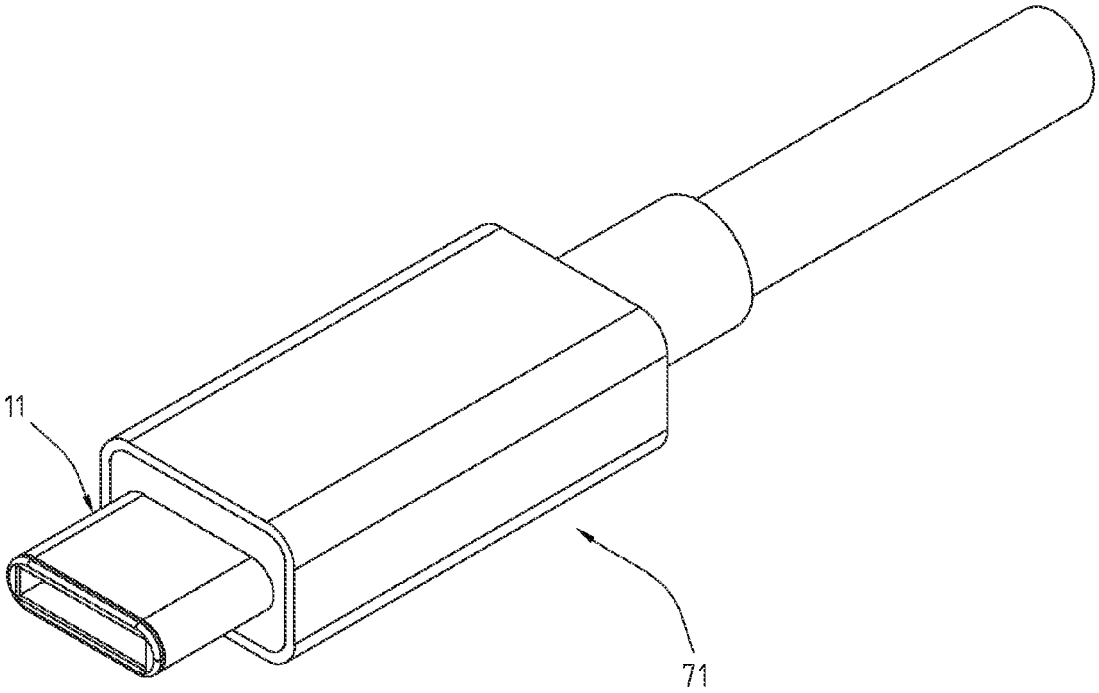
FIG. 8A illustrates a perspective view of the electrical plug connector according to the instant disclosure, where the electrical plug connector is combined with an insulation casing, for one variation.
Figure 8B:
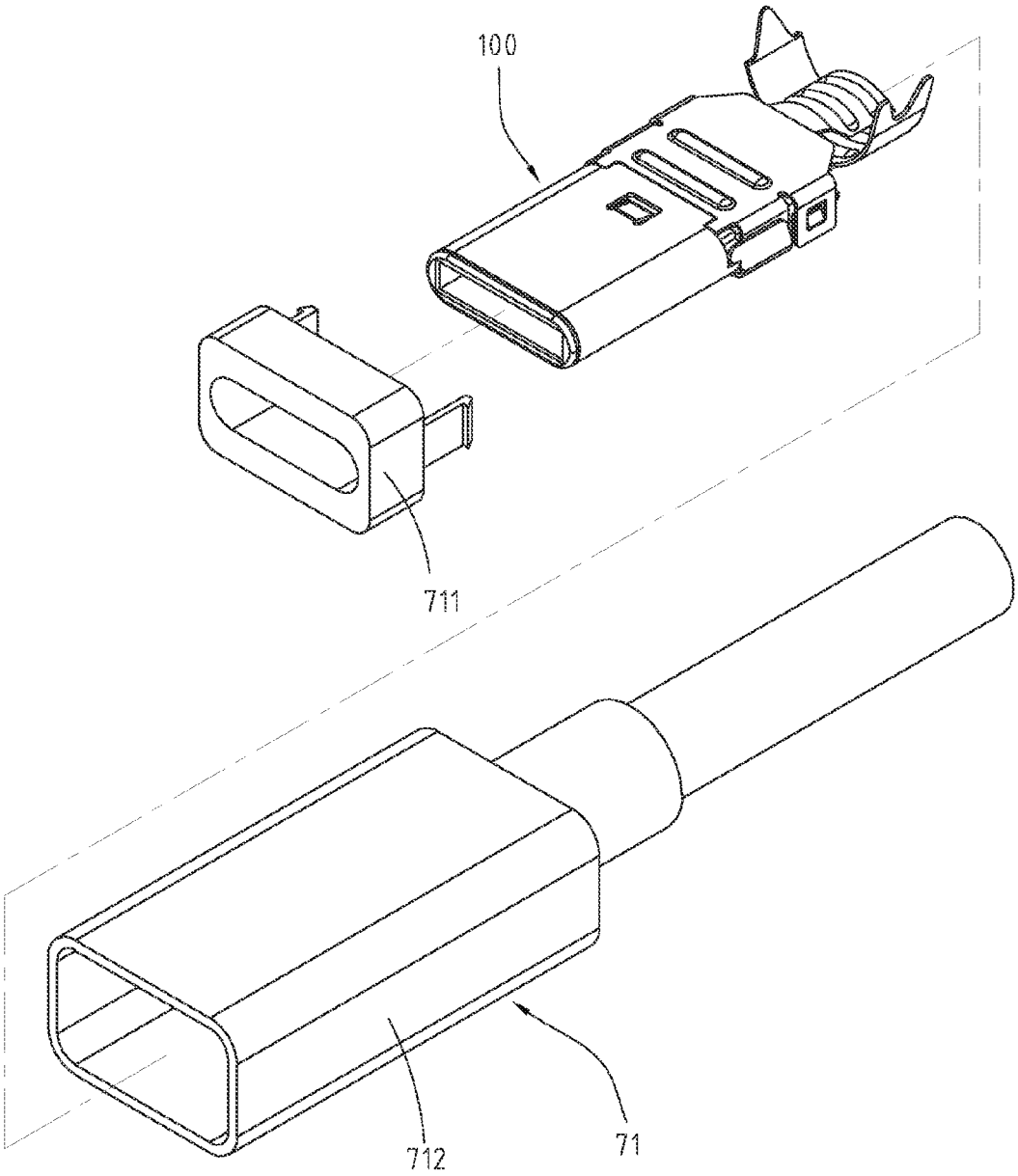
FIG. 8B illustrates a partial exploded view of the electrical plug connector according to the instant disclosure, where the electrical plug connector is combined with an insulation casing, for one variation.

In some embodiments, the insulation casing 71 may be a unitary structure (as shown in FIG. 2 and FIG. 7) or a two-piece structure (as shown in FIG. 8A and FIG. 8B). Regarding the insulation casing 71 being a two-piece structure, the insulation casing 71 comprises a front cover 711 and a rear cover 712 (as shown in FIGS. 8A and 8B). The front cover 711 and the rear cover 712 can be combined with each other by means of gluing, buckling, or a combination of the foregoing two means. Alternatively, a further outer mould may be applied to enclose the front cover 711 and the rear cover 712 for the combination of the front cover 711 and the rear cover 712.

Please refer to FIG. 3. In some embodiments, the electrical plug connector 100 is further provided with a grounding sheet 51 at the insulation housing 21. The grounding sheet 51 comprises a body portion 511 and a plurality of pins 512. The body portion 511 is located between the upper-row elastic terminals 31 and the lower-row elastic terminals 41 to separate the upper-row elastic terminals 31 from the lower-row elastic terminals 41. The pins 512 are extending from the two sides of the body 511, exposed out of the insulation housing 21, and in contact with the metal shell 11 or the circuit board 91. Accordingly, the crosstalk interference can be improved due to the grounding sheet 51 during signal transmission.

Please refer to FIG. 2 and FIG. 3. In some embodiments, the electrical plug connector 100 is further provided with a plurality of clamping structures 52 at the two sides of the insulation housing 21. Each of the clamping structures 52 comprises a projecting hook portion 521 and a projecting contact portion 522. The projecting hook portions 521 are fixed at the two sides of the insulation housing 21. The outer surface of each of the projecting hook portions 521 is in contact with the metal shell 11. Here, each of the projecting hook portions 521 is provided with an inverse barbed bump 5211, a round bump 5212, and an elastic sheet 5213, but embodiments are not limited thereto. In implementation, each of the projecting hook portions 521 may be provided with at least one of the inverse barbed bump 5211, the round bump 5212, and the elastic sheet 5213. The projecting hook portions 521 are assembled to the insulation casing 21. In addition, the projecting contact portions 522 are extending from the front portions of the projecting hook portions 521 and inserted into the two sides of the mating room 213. Accordingly, when the electrical plug connector 100 is plugged into the electrical receptacle connector, a plurality of hook structures at the two sides of the electrical receptacle connector can be in contact with the projecting contact portions 522. Therefore, the projecting hook portions 521 are in contact with the metal shell 11 to provide conduction and grounding.

Figure 12:
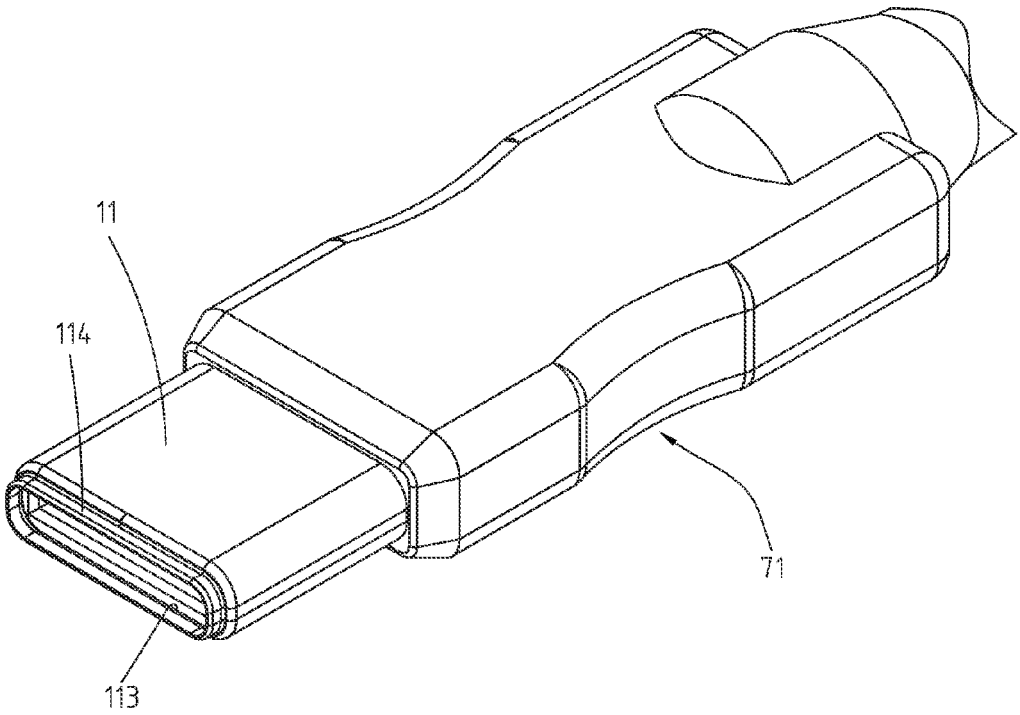
FIG. 12 illustrates a perspective view of the electrical plug connector provided with a tubular portion.

Please refer to FIG. 12. In some embodiments, the metal shell 11 is provided with a tubular portion 114 forward extending from the front end of the plug opening 113, and innerly narrowed in the radial direction. Here, the tubular portion 114 may be formed on the metal shell 11 by applying a suitable deep drawing technique to a conductive metal sheet to gradually deform the conductive metal sheet by repeated operations. When the electrical plug connector 100 is plugged into the electrical receptacle connector, the outer lateral surface of the tubular portion 113 would be in contact with a plurality of conductive plates of the electrical receptacle connector, so that the tubular portion 113 and the metal shell 11 are combined with each other for conduction and grounding. Accordingly, the EMI problem can be reduced.

Figure 10:
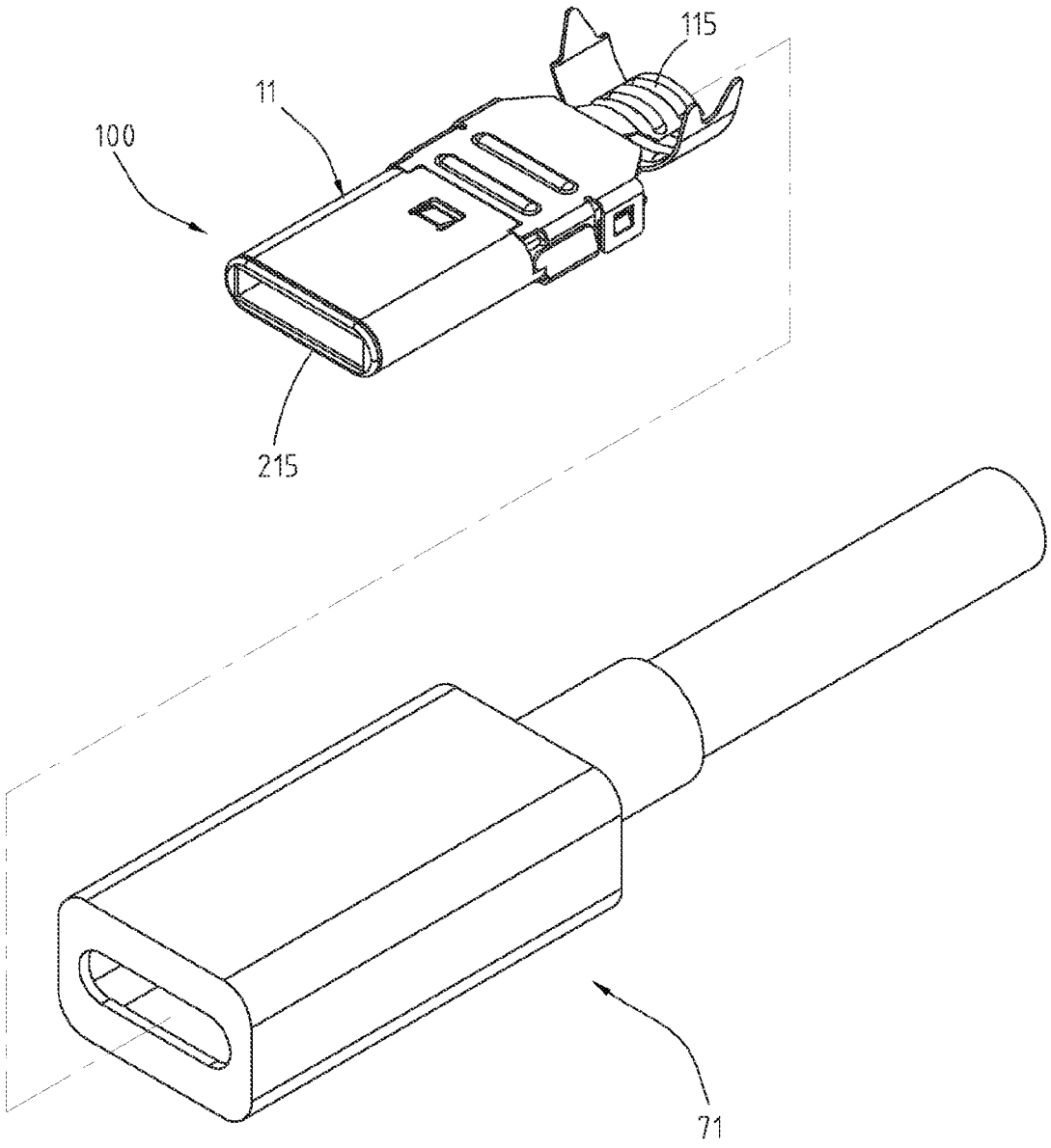
FIG. 10 illustrates a partial exploded view of the electrical plug connector provided with a frame portion.

Please refer to FIG. 2. In some embodiments, the metal shell 11 is further provided with an inclined guiding surface 1131 at the outer lateral surface of the plug opening 113. The metal shell 11 can be provided with the inclined guiding surface 1131 by applying a drawing or stamping technique. The inclined guiding surface 1131 facilitates the connection between the electrical plug connector 100 and the electrical receptacle connector when the electrical plug connector 100 is to be inserted into the electrical receptacle connector, but embodiments are not limited thereto. In some embodiments, the insulation housing 21 is provided with a frame portion 215 (as shown in FIG. 10 and FIG. 11). The frame portion 215 is extending from the front end of the insulation housing 21. In other words, the frame portion 215 is extending from the front portions of the upper member 211 and the lower member 212 to surround the periphery of the plug opening 113. The frame portion 215 is provided with an inclined guiding surface 2151. When the electrical plug connector 100 is plugged into the electrical receptacle connector, the electrical receptacle connector can be in contact with the inclined guiding surface 2151 of the frame portion 215 to facilitate the connection between the electrical plug connector 100 and the electrical receptacle connector.

Figure 13:
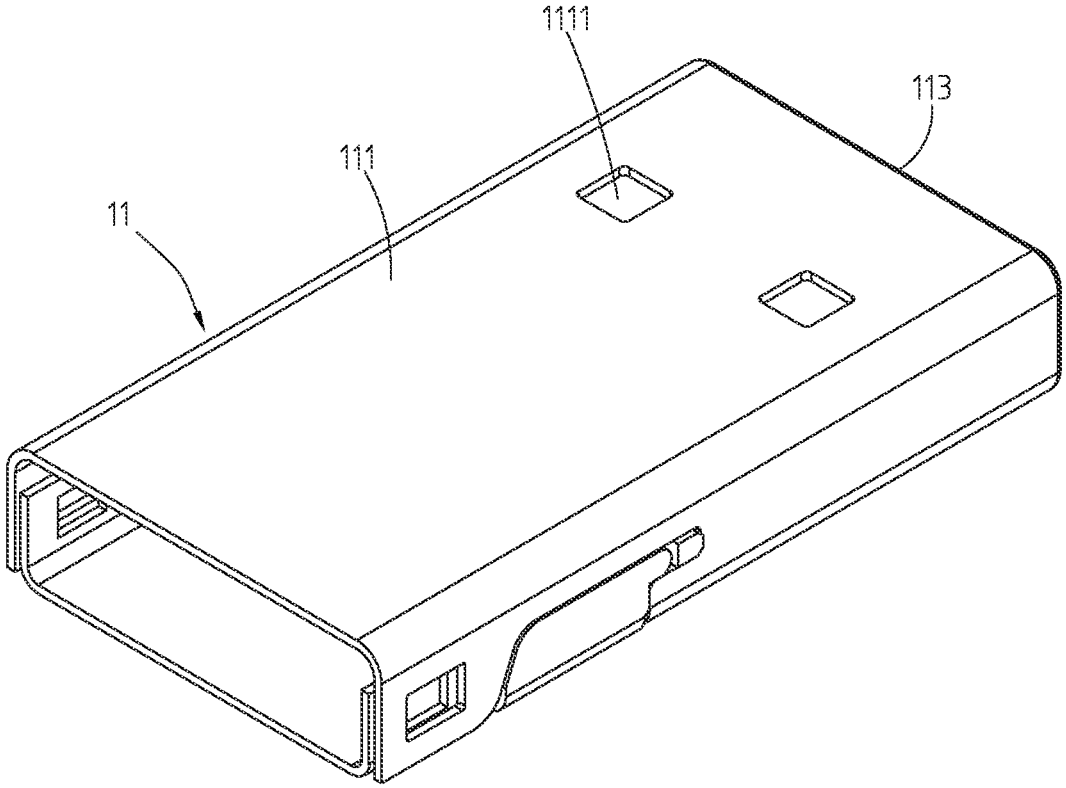
FIG. 13 illustrates a perspective view of the electrical plug connector provided with buckle holes.

Please refer to FIG. 13 and FIG. 14. In some embodiments, the metal shell 11 is further provided with a main body 111 and a plurality of buckle holes 1111. The buckle holes 1111 are formed on the main body 111 and adjacent to the plug opening 113. The metal shell 11 can be provided with the buckle holes 1111 in a half-stamping technique or a stamping technique. When the electrical plug connector 100 is plugged into the electrical receptacle connector, the elastic sheets of the electrical receptacle connector are buckled into the buckle holes 1111. In addition, the metal shell 11 is further provided with a plurality of extension sheets 1112 (as shown in FIG. 15). Each of the extension sheets 1112 is connected between opposite inner walls of the corresponding buckle hole 1111. Accordingly, the elastic sheets of the electrical receptacle connector are buckled onto the extension sheets 1112.

Figure 16:
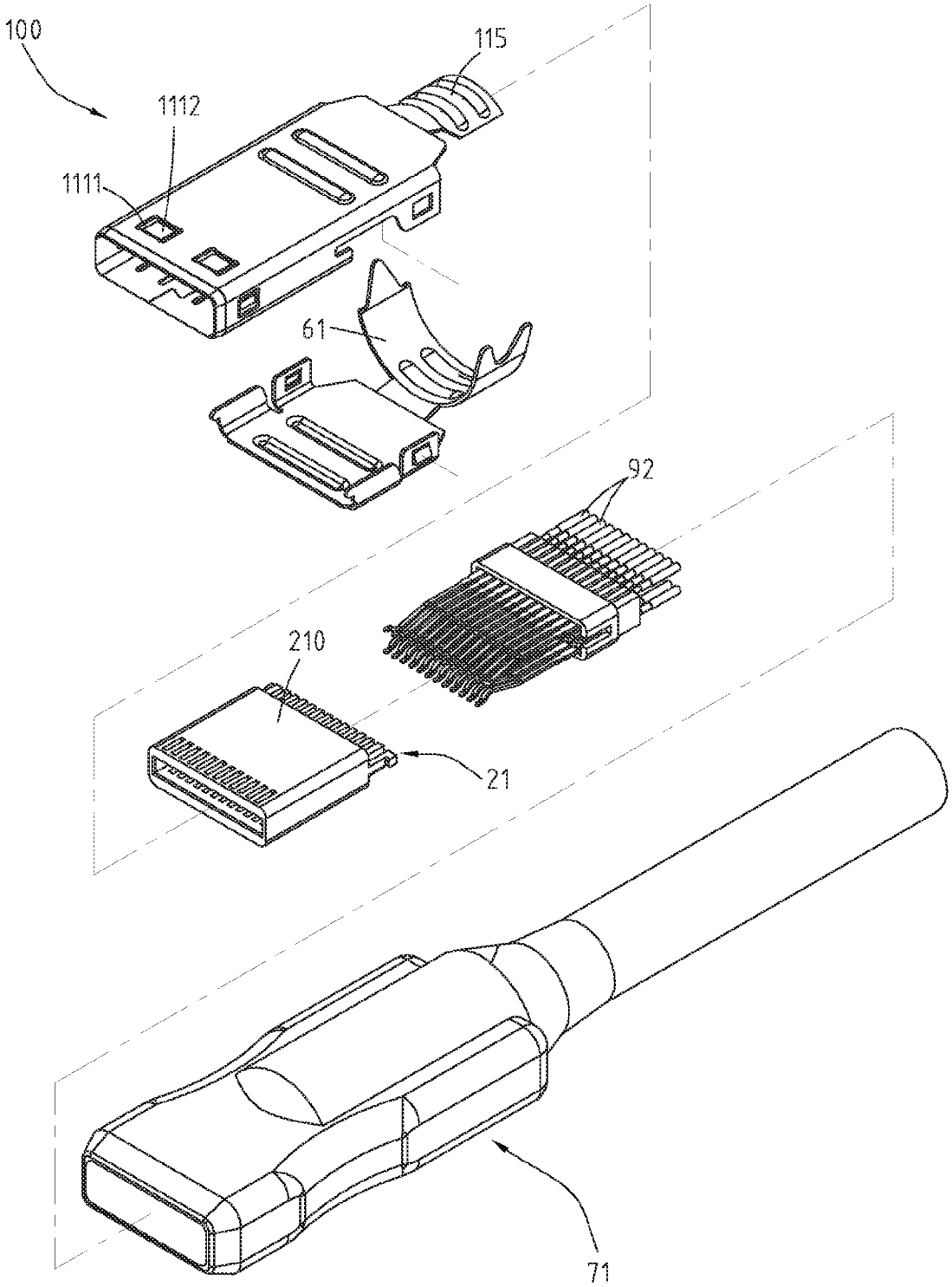
FIG. 16 illustrates an exploded view of the electrical plug connector combined with a clamping shell.

Please refer to FIG. 16. In some embodiments, the electrical plug connector 100 may be further combined with a clamping shell 61. The metal shell 11 is provided with a rear-end clamping piece 115. The clamping shell 61 is combined with the rear-end clamping piece 115 to enclose the wire 92. Accordingly, the clamping shell 61 is combined with the metal shell 21, where the clamping shell 61 may be a unitary structure or a multi-piece structure.

In conclusion, since the upper-row elastic terminals and the lower-row elastic terminals are arranged upside down, and the pin configuration of the upper-row elastic signal terminals is left-right reversal with respect to that of the lower-row elastic signal terminals. When the electrical plug connector is inserted into an electrical receptacle connector by a first orientation where an upper plane of the electrical plug connector is facing up, the upper-row elastic terminals of the electrical plug connector are in contact with upper-row plate signal terminals of the electrical receptacle connector. Conversely, when the electrical plug connector is inserted into the electrical receptacle connector by a second orientation where the upper plane of the electrical plug connector is facing down, the upper-row elastic terminals of the electrical plug connector are in contact with lower-row plate signal terminals of the electrical receptacle connector. Consequently, the inserting orientation of the electrical plug connector is not limited when inserting into an electrical receptacle connector. Besides, a plurality of clamping structures are extending and inserted into two sides of the mating room to be in contact with hook structures located at two sides of an electrical receptacle connector. Therefore, the clamping structures are connected to the metal shell for conduction and grounding. Furthermore, a grounding sheet is located on the insulation housing and between the upper-row elastic terminals and the lower-row elastic terminals, thus the crosstalk interference can be improved by the grounding sheet during signal transmission.

While the disclosure has been described by the way of example and in terms of the preferred embodiments, it is to be understood that the instant disclosure need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metal shell defining a receiving cavity therein;

an insulation housing received in the receiving cavity, wherein the insulation housing comprises a base portion, an upper member, a lower member, and defines a mating room, wherein the upper member and the lower member extend from one side of the base portion, and the mating room is located between the upper member and the lower member;

a plurality of upper-row elastic terminals held on a lower surface of the upper member, wherein the upper-row elastic terminals comprise a plurality of upper-row elastic signal terminals, at least one upper-row elastic power terminal, and at least one upper-row elastic ground terminal;

a plurality of lower-row elastic terminals held on an upper surface of the lower member, wherein the lower-row elastic terminals comprise a plurality of lower-row elastic signal terminals, at least one lower-row elastic power terminal, and at least one lower-row elastic ground terminal; and a plurality of clamping structures, wherein each of the clamping structures comprises a projecting contact portion, and the projecting contact portions extend inwardly toward the mating room from the two sides of the mating room;

wherein the upper-row elastic signal terminals are at the lower surface of the upper member for transmitting first signals, the lower-row elastic signal terminals are at the upper surface of the lower member for transmitting second signals, the specification for transmitting the first signals is conformed to the specification for transmitting the second signals, the upper-row elastic terminals and the lower-row elastic terminals are point-symmetrical with a central point of the receiving cavity as the symmetrical center.

2. The electrical plug connector according to claim 1, wherein the distance between the at least one upper-row elastic power terminal and an upper front lateral surface of the upper member is less than or equal to the distance between each of the upper-row elastic signal terminals and the upper front lateral surface of the upper member.

3. The electrical plug connector according to claim 2, wherein the distance between the at least one upper-row elastic ground terminal and the upper front lateral surface of the upper member is less than or equal to the distance between each of the upper-row elastic signal terminals and the upper front lateral surface of the upper member.

4. The electrical plug connector according to claim 2, wherein the width of the at least one upper-row elastic power terminal is greater than or equal to the width of each of the upper-row elastic signal terminals.

5. The electrical plug connector according to claim 1, wherein each of the upper-row elastic terminals comprises an upper-row contact segment, an upper-row connecting segment, and an upper-row soldering segment, wherein the upper-row connecting segment is at the upper member, the upper-row contact segment is extending from one of two ends of the upper-row connecting segment and at the lower surface of the upper member, and the upper-row soldering segment is extending from the other end of the upper-row connecting segment and protruded out of the insulation housing, wherein each of the lower-row elastic terminals comprises a lower-row contact segment, a lower-row connecting segment, and a lower-row soldering segment, wherein the lower-row connecting segment is at the lower member, the lower-row contact segment is extending from one of two ends of the lower-row connecting segment and at the upper surface of the lower member, and the lower-row soldering segment is extending from the other end of the lower-row connecting segment and protruded out of the insulation housing.

6. The electrical plug connector according to claim 5, wherein the position of the upper-row elastic terminals corresponds to the position of the lower-row elastic terminals.

7. The electrical plug connector according to claim 5, wherein the upper-row soldering segments and the lower-row soldering segments ends are protruded out of the rear part of the insulation housing to be separately arranged.

8. The electrical plug connector according to claim 7, wherein each of the upper-row elastic terminals comprises an upper-row bending segment extending between the upper-row connecting segment and the upper-row soldering segment, and the upper-row bending segment is provided for adjusting the distance between the upper-row soldering segment and the lower-row soldering segment.

9. The electrical plug connector according to claim 7, wherein each of the lower-row elastic terminals comprises a lower-row bending segment extending between the lower-row connecting segment and the lower-row soldering segment, and the lower-row bending segment is provided for adjusting the distance between the lower-row soldering segment and the upper-row soldering segment.

10. The electrical plug connector according to claim 7, further comprising a rear plugging member, wherein the rear plugging member is fixed at the rear part of the insulation housing and comprises a plurality of through grooves, and the upper-row soldering segments and the lower-row soldering segments are held in the through grooves.

11. The electrical plug connector according to claim 7, further comprising a circuit board, wherein the circuit board is fixed at the rear part of the insulation housing, a plurality of upper-surface contacts is located on one of two surfaces of the circuit board to be connected to the upper-row soldering segments, and a plurality of lower-surface contacts is located on the other surface of the circuit board to be connected to the lower-row soldering segments.

12. The electrical plug connector according to claim 11, wherein the metal shell comprises a plurality of fixing grooves, and wherein two sides of the circuit board are held in the fixing grooves.

13. The electrical plug connector according to claim 1, wherein the metal shell defines a plug opening therein, wherein the plug opening is in the shape of oblong or rectangular.

14. The electrical plug connector according to claim 13, wherein the plug opening comprises an inclined guiding surface.

15. The electrical plug connector according to claim 13, wherein the metal shell comprises a tubular portion forwardly extending from the front end of the plug opening and innerly narrowed in the radial direction.

16. The electrical plug connector according to claim 13, wherein the insulation housing comprises a frame portion extending from the front end of the plug opening to surround the periphery of the plug opening.

17. The electrical plug connector according to claim 16, wherein the frame portion comprises an inclined guiding surface.

18. The electrical plug connector according to claim 1, wherein the metal shell comprises a main body and a plurality of buckle holes formed on the surface of the main body.

19. The electrical plug connector according to claim 18, wherein the metal shell comprises a plurality of extension sheets, each of the extension sheets is connected between opposite inner walls of the corresponding buckle hole.

20. The electrical plug connector according to claim 1, further comprising a clamping shell, the metal shell comprises a rear-end clamping piece, and the clamping shell is combined with the rear-end clamping piece.

21. An electrical plug connector, comprising:

a metal shell defining a receiving cavity therein;

an insulation housing received in the receiving cavity, wherein the insulation housing comprises a base portion, an upper member, a lower member, and defines a mating room, wherein the upper member and the lower member are extended from one side of the base portion, and the mating room is located between the upper member and the lower member;

a plurality of upper-row elastic terminals held on a lower surface of the upper member, wherein the upper-row elastic terminals comprise a plurality of upper-row elastic signal terminals, at least one upper-row elastic power terminal, and at least one upper-row elastic ground terminal, wherein each upper-row elastic terminal comprises an upper-row soldering segment protruded out of the rear part of the insulation housing a plurality of lower-row elastic terminals held on an upper surface of the lower member, wherein the lower-row elastic terminals comprise a plurality of lower-row elastic signal terminals, at least one lower-row elastic power terminal, and at least one lower-row elastic ground terminal, wherein each lower-row elastic terminal comprises a lower-row soldering segment protruded out of the rear part of the insulation housing;

a rear plugging member fixed at the rear part of the insulation housing and comprising a plurality of through grooves, wherein the upper-row soldering segments and the lower-row soldering segments are held in the through grooves; and a plurality of wires located on the rear plugging member to be connected to the upper-row soldering segments and the lower-row soldering segments;

wherein the upper-row elastic signal terminals are at the lower surface of the upper member for transmitting first signals, the lower-row elastic signal terminals are at the upper surface of the lower member for transmitting second signals, the specification for transmitting the first signals is conformed to the specification for transmitting the second signals, the upper-row elastic terminals and the lower-row elastic terminals are point-symmetrical with a central point of the receiving cavity as the symmetrical center.

22. The electrical plug connector according to claim 21, further comprising a fixing plate, wherein the circumferences of the wires are fixed to the fixing plate.

23. The electrical plug connector according to claim 21, further comprising a cover piece covering the wires, the upper-row soldering segments, and the lower-row soldering segments.

24. The electrical plug connector according to claim 11, further comprising a plurality of wires located on the circuit board to be connected to the upper-row soldering segments and the lower-row soldering segments.

25. The electrical plug connector according to claim 24, further comprising a fixing plate, wherein the circumferences of the wires are fixed to the fixing plate.

26. The electrical plug connector according to claim 24, further comprising a ground plate to be connected to the wires and the circuit board.

27. The electrical plug connector according to claim 24, further comprising a cover piece covering the wires, the upper-row soldering segments, and the lower-row soldering segments.

28. The electrical plug connector according to claim 1, further comprising an insulation casing covering the rear part of the metal shell.

29. The electrical plug connector according to claim 1, wherein the distance between the at least one lower-row power terminal and a lower front lateral surface of the lower member is less than or equal to the distance between each of the lower-row elastic signal terminals and the lower front lateral surface of the lower member.

30. The electrical plug connector according to claim 29, wherein the distance between the at least one lower-row elastic ground terminal and the lower front lateral surface of the lower member is less than or equal to the distance between each of the lower-row elastic signal terminals and the lower front lateral surface of the lower member.

31. The electrical plug connector according to claim 29, wherein the width of the at least one lower-row power terminal is greater than or equal to the width of each of the lower-row elastic signal terminals.

32. The electrical plug connector according to claim 1, further comprising a grounding sheet located between the upper-row elastic terminals and the lower-row elastic terminals.

33. The electrical plug connector according to claim 1, wherein each of the clamping structures further comprises a projecting hook portion, the projecting contact portion is extended from the front portion of the projecting hook portion, and the projecting hook portions are fixed at the two sides of the insulation housing.

34. The electrical plug connector according to claim 33, wherein the outer surface of each projecting hook portion is in contact with the metal shell.

35. An electrical plug connector, comprising:

a metal shell defining a receiving cavity therein;

an insulation housing received in the receiving cavity, wherein the insulation housing comprises a base portion, an upper member, a lower member, and defines a mating room, wherein the upper member and the lower member are extended from one side of the base portion, and the mating room is located between the upper member and the lower member;

a plurality of elastic terminals held on a lower surface of the upper member or an upper surface of the lower member, wherein the elastic terminals comprise a plurality of elastic signal terminals, at least one elastic power terminal, and at least one elastic ground terminal; and a plurality of clamping structures, wherein each of the clamping structures comprises a projecting contact portion and the projecting contact portions extend inwardly toward to the mating room from the two sides of the mating room.

* * * * *